US011565528B2

(12) United States Patent
Akima et al.

(10) Patent No.: US 11,565,528 B2
(45) Date of Patent: Jan. 31, 2023

(54) INKJET PRINTING DEVICE AND INKJET PRINTING METHOD

(71) Applicant: RICOH COMPANY, LTD., Tokyo (JP)

(72) Inventors: Mio Akima, Tokyo (JP); Hiroaki Takahashi, Kanagawa (JP); Akiko Bannai, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 17/277,147

(22) PCT Filed: Aug. 30, 2019

(86) PCT No.: PCT/JP2019/034277

§ 371 (c)(1),
(2) Date: Mar. 17, 2021

(87) PCT Pub. No.: WO2020/110403

PCT Pub. Date: Jun. 4, 2020

(65) Prior Publication Data

US 2021/0362503 A1 Nov. 25, 2021

(30) Foreign Application Priority Data

Nov. 29, 2018 (JP) ..... JP2018-223002

(51) Int. Cl.
*B41J 2/165* (2006.01)

(52) U.S. Cl.
CPC ..... *B41J 2/16535* (2013.01); *B41J 2/16552* (2013.01); *B41J 2002/16558* (2013.01)

(58) Field of Classification Search
CPC ..... B41J 2/16552; B41J 2002/16558
See application file for complete search history.

(56) References Cited

U.S. PATENT DOCUMENTS 6,460,967 B1 * 10/2002 Makita ..... B41J 2/16552 347/33
2012/0281049 A1 11/2012 Kachi
(Continued)

FOREIGN PATENT DOCUMENTS

EP 3336151 A1 6/2018
JP 2008-213271 9/2008
(Continued)

OTHER PUBLICATIONS

International Search Report dated Nov. 22, 2019 for counterpart International Patent Application No. PCT/JP2019/034277 filed Aug. 30, 2019.
(Continued)

*Primary Examiner* — Sharon Polk
(74) *Attorney, Agent, or Firm* — Grüneberg and Myers, PLLC

(57) ABSTRACT

An inkjet printing device including: an ink storage unit configured to store an ink; an ejection head having a nozzle configured to eject the ink to a printing material; a heating unit configured to heat the printing material; and a washing unit configured to wash a nozzle-formed surface of the head with a washing liquid, wherein the ink is a clear ink including a resin, the device has a low gloss printing mode that is a printing mode for applying low gloss and a high gloss printing mode that is a printing mode for applying high gloss, and the inkjet printing device satisfies: $T_{matte}>T_{gloss}$ where $T_{matte}$ (degrees Celsius) is a temperature of the heating unit when printing is performed with the low gloss printing mode, and $T_{gloss}$ (degrees Celsius) is a temperature of the heating unit when printing is performed with the high gloss printing mode.

20 Claims, 3 Drawing Sheets

(56) References Cited

U.S. PATENT DOCUMENTS

| | | | | |
|---|---|---|---|---|
| 2014/0085376 | A1* | 3/2014 | Kato | B41J 2/16552 347/33 |
| 2014/0375720 | A1 | 12/2014 | Sato et al. | |
| 2017/0183528 | A1 | 6/2017 | Kohzuki et al. | |
| 2017/0267879 | A1 | 9/2017 | Kohzuki et al. | |
| 2018/0170061 | A1 | 6/2018 | Nakamura et al. | |
| 2019/0270903 | A1* | 9/2019 | Kohzuki | C09D 11/38 |
| 2019/0038181 | A1 | 12/2019 | Takahashi et al. | |
| 2019/0381811 | A1 | 12/2019 | Masuda et al. | |
| 2021/0016327 | A1 | 1/2021 | Atake et al. | |

FOREIGN PATENT DOCUMENTS

| | | | |
|---|---|---|---|
| JP | 5421323 | B2 | 11/2013 |
| JP | 2015-003397 | A | 1/2015 |
| JP | 2015028098 | | 2/2015 |
| JP | 2017043004 | | 3/2017 |
| JP | 2018-069730 | | 5/2018 |
| JP | 2018-095841 | | 6/2018 |
| JP | 2019-162850 | A | 9/2019 |

OTHER PUBLICATIONS

Written Opinion dated Nov. 22, 2019 for counterpart International Patent Application No. PCT/JP2019/034277 filed Aug. 30, 2019.
Japanese Office Action dated Jul. 5, 2022 in corr. Japanese Application No. 2018-223002 (with English translation).
Japanese Office Action dated Oct. 11, 2022, in Japanese Application No. 2018-223002, with English translation, 12 pages.

* cited by examiner

[Fig. 1]
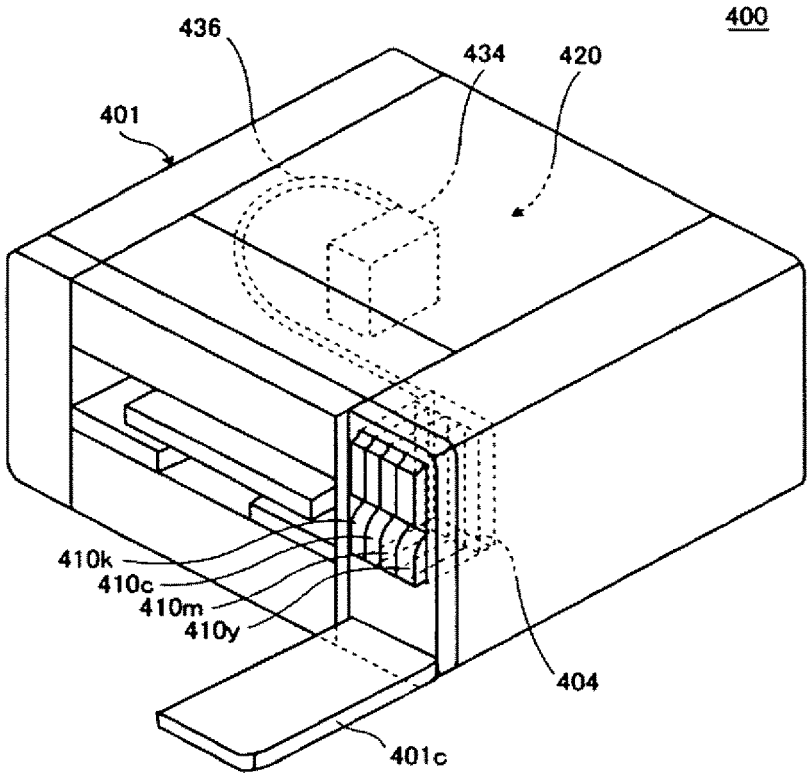
[Fig. 2]
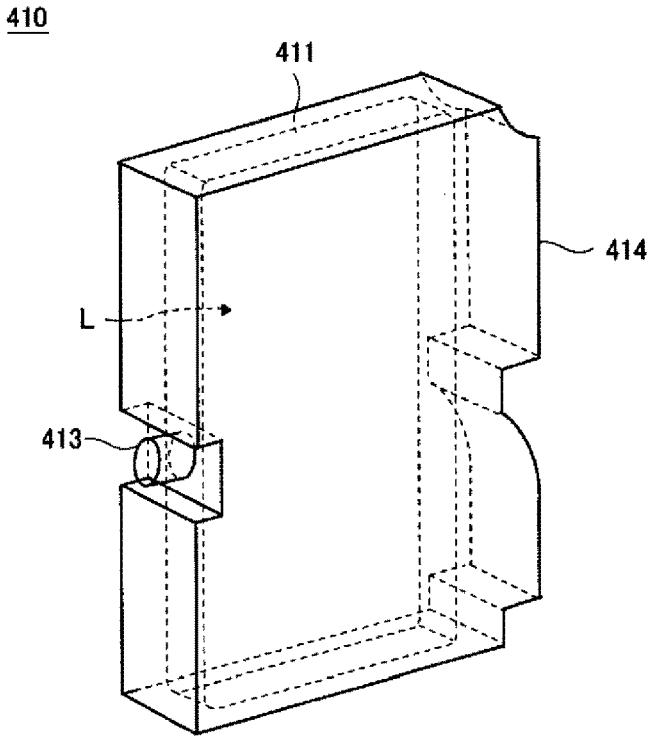

[Fig. 3]
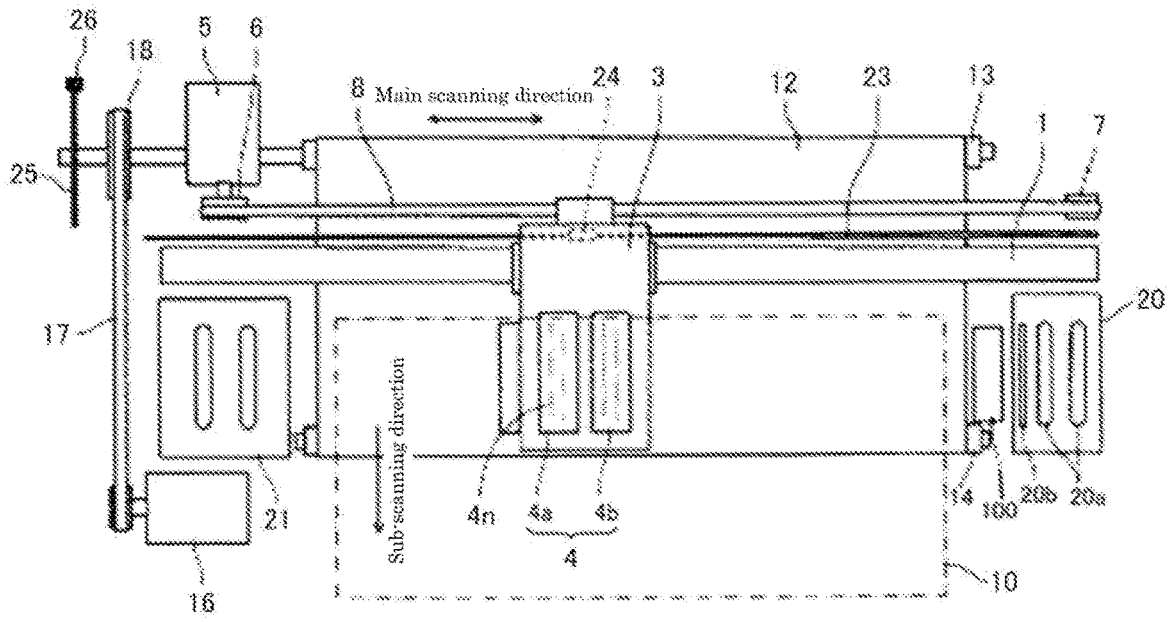
[Fig. 4]
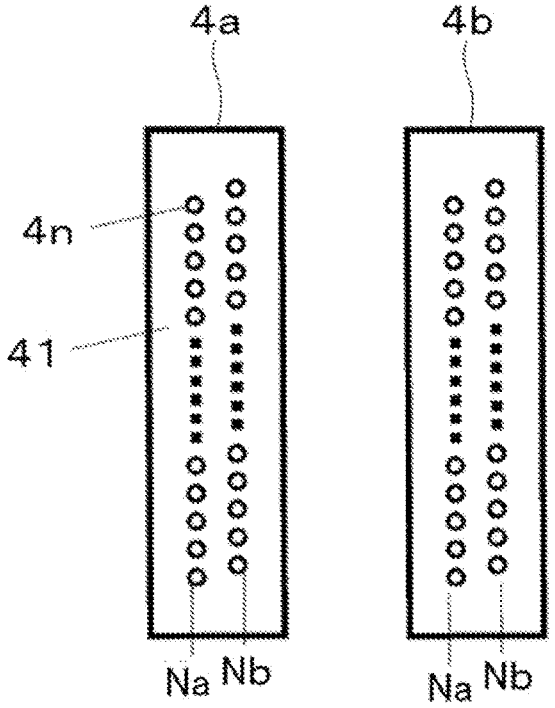

[Fig. 5]
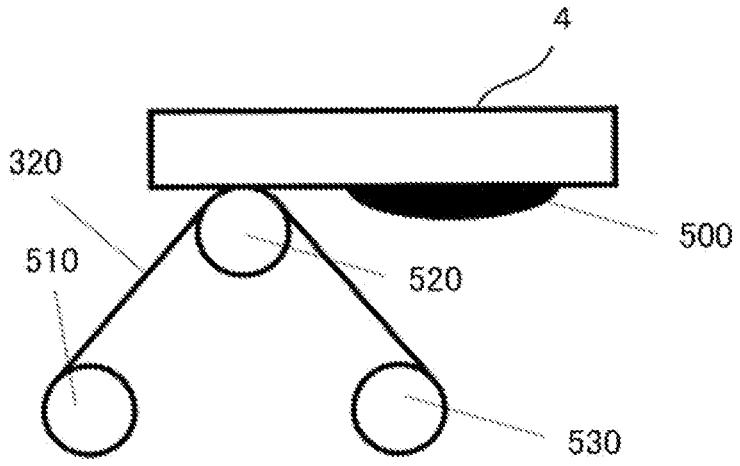
[Fig. 6]
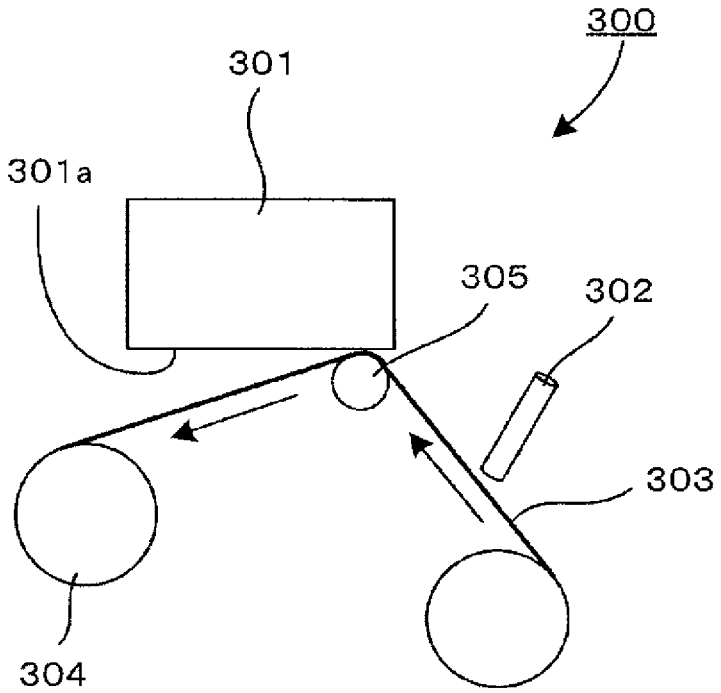

INKJET PRINTING DEVICE AND INKJET PRINTING METHOD

TECHNICAL FIELD

The present disclosure relates to an inkjet printing device, and an inkjet printing method.

BACKGROUND ART

In order to improve durability (e.g., lightfastness, water resistance, and abrasion resistance) of wrapping materials for industrial use (e.g., advertising and billboard), food, and drinks, for example, non-permeable recording media, such as plastic films, have been used. Various inks used for such non-permeable recording media have been developed.

Inkjet printing devices having a function of controlling gloss have been developed.

For example, proposed is a liquid jetting device including a liquid jet head capable of jetting an ink including thermoplastic resin particles towards a landing target and a heating unit configured to heat the ink droplets landed on the landing target, where the heating unit configured to control a degree of film formation of surfaces of the ink droplets by heating at a film formation controlling temperature corresponding to the minimum film formation temperature at which the surfaces of the ink droplets start to form a film (see, for example, PTL 1).

CITATION LIST

Patent Literature

PTL 1: Japanese Unexamined Patent Application Publication No. 2015-3397

SUMMARY OF INVENTION

Technical Problem

The present disclosure has an object to provide an inkjet printing device that can improve ejection reliability as well as corresponding to glossiness control of both matte gloss and gloss.

Solution to Problem

According to one aspect of the present disclosure, an inkjet printing device including: an ink storage unit configured to store an ink; an ejection head having a nozzle configured to eject the ink to a printing material; a heating unit configured to heat the printing material; and a washing unit configured to wash a nozzle-formed surface of the ejection head with a washing liquid, wherein the ink is a clear ink including a resin, the inkjet printing device has a low gloss printing mode that is a printing mode for applying low gloss, and a high gloss printing mode that is a printing mode for applying high gloss, and the inkjet printing device satisfies the following formula:

$$T_{matte} > T_{gloss}$$

where $T_{matte}$ (degrees Celsius) is a temperature of the heating unit when printing is performed with the low gloss printing mode, and $T_{gloss}$ (degrees Celsius) is a temperature of the heating unit when printing is performed with the high gloss printing mode.

Advantageous Effects of Invention

The present disclosure can provide an inkjet printing device that can improve ejection reliability as well as corresponding to glossiness control of both matte gloss and gloss.

BRIEF DESCRIPTION OF DRAWINGS

FIG. 1 is a schematic view illustrating an example of an image forming apparatus for carrying out an image forming method of the present disclosure.

FIG. 2 is a perspective view illustrating an example of a main tank of the image forming apparatus of FIG. 1.

FIG. 3 is a schematic view illustrating another example of an image forming apparatus for carrying out the image forming method of the present disclosure.

FIG. 4 is a schematic view illustrating an example of a nozzle plate wiped with a wiping member.

FIG. 5 is a schematic view illustrating an example of a washing unit of the inkjet printing device of the present disclosure.

FIG. 6 is a schematic view illustrating another example of the washing unit of the inkjet printing device of the present disclosure.

DESCRIPTION OF EMBODIMENTS (Inkjet Printing Device and Inkjet Printing Method)

An inkjet printing device of the present disclosure includes an ink storage unit configured to store an ink, an ejection head having a nozzle configured to eject the ink to a printing material, a heating unit configured to heat the printing material, and a washing unit configured to wash a nozzle-formed surface of the ejection head with a washing liquid. The ink is a clear ink including a resin. The inkjet printing device has a matte gloss printing mode that is a printing mode for applying matte gloss, and a gloss printing mode that is a printing mode for applying gloss. The inkjet printing device satisfies the following formula:

$$T_{matte} > T_{gloss}$$

where $T_{matte}$ (degrees Celsius) is a temperature of the heating unit when printing is performed with the matte gloss printing mode, and $T_{gloss}$ (degrees Celsius) is a temperature of the heating unit when printing is performed with the gloss printing mode. The inkjet printing device may further include other units according to the necessity.

An inkjet printing method of the present disclosure includes: ejecting an ink to a printing material using an ejection head having a nozzle to form a print layer; heating the printing material printed; and washing a nozzle-formed surface of the ejection head with a washing liquid. The ink is a clear ink including a resin. The inkjet printing method has a low gloss printing mode that is a printing mode for applying low gloss, and a high gloss printing mode that is a printing mode for applying high gloss. The heating is heating to satisfy the following formula:

$$T_{matte} > T_{gloss}$$

where $T_{matte}$ (degrees Celsius) is a temperature of a heating unit in the heating when printing is performed with the low gloss printing mode, and $T_{gloss}$ (degrees Celsius) is a temperature of the heating unit in the heating when printing is performed with the high gloss printing mode. The inkjet printing method may further include other steps according to the necessity.

A conventional clear ink capable of controlling gloss has a high resin content compared to a color ink. When the clear ink is printed by an inkjet printing device, therefore, there is a problem that the resin deposited on a nozzle-formed surface of an ejection heat is adhered.

In the art, a degree of film formation of a surface of an ink droplet is controlled to control glossiness by heating a color ink including a film formation controlling temperature according to the minimum film formation temperature at which film formation of the ink droplet is initiated by means of a heating unit. According to the inkjet printing device and inkjet printing method of the present disclosure, a clear ink free from a colorant is used, and therefore a sufficient glossiness difference is obtained, and gloss control of both matte and gloss can be achieved.

The inkjet printing device and inkjet printing method of the present disclosure use a clear ink including a resin, and gloss perform gloss control of both gloss and matte through control of a temperature of a heating unit. When matte gloss is imparted, printing is performed at a high temperature of the heating unit compared with a temperature during printing in the gloss printing mode. Since the temperature of the hearing unit is high, the clear ink including a resin suppresses wet spreading of dots and coalescence of adjacent dots, and dots having a large height of a dot sphere (pile height) are formed. These dots form surface irregularities to impart matte gloss.

When gloss is imparted, on the other hand, printing is performed at a low temperature of the heating unit compared with the matte gloss printing mode. Since the temperature of the heating unit is low, the clear ink including a resin accelerates wet spreading of dots and coalescence of adjacent dots to form a smooth surface. Therefore, gloss is imparted.

As described above, a matte gloss printing mode corresponding to a low gloss printing mode and a gloss printing mode corresponding to a high gloss printing mode are set.

Accordingly, the inkjet printing device of the present disclosure can perform gloss control of both matte and gloss, because the inkjet printing device uses a clear ink including a resin, has a matte gloss printing mode that is a printing mode for imparting matte gloss, and a gloss printing mode that is a printing mode for imparting gloss, and satisfies the following formula $T_{matte}>T_{gloss}$, where $T_{matte}$ (degrees Celsius) is a temperature of a heating unit when printing is performed with the matte gloss printing mode, and $T_{gloss}$ (degrees Celsius) is a temperature of a heating unit when printing is performed with the gloss printing mode.

In the inkjet printing device of the present disclosure, a temperature of the heating unit satisfies the following formula $T_{matte}>T_{gloss}$, preferably satisfies the following formula $T_{matte}$ $T_{gloss}\geq 10$ degrees Celsius, and more preferably satisfies the following formula $T_{matte}$ $T_{gloss}\geq 20$ degrees Celsius.

As a result, the temperature of the heating unit is set high in the matte gloss printing mode to suppress wet spreading of dots and therefore dots of high pile heights are formed to form a surface having large irregularities. On the other hand, the temperature of the heating unit is set low in the gloss printing mode to accelerate wet spreading of dots to form a smooth surface owing to coalescence of the adjacent dots.

The temperature $T_{matte}$ (degrees Celsius) of the heating unit when printing is performed with the matte gloss printing mode is preferably 50 degrees Celsius or higher, more preferably 50 degrees Celsius or higher but 80 degrees Celsius or lower.

The temperature $T_{gloss}$ (degrees Celsius) of the heating unit when printing is performed with the gloss printing mode is preferably 70 degrees Celsius or lower, more preferably 60 degrees Celsius or lower.

Glossiness can be largely changed with the printing modes using the clear ink by setting the above-mentioned temperature ranges.

Examples of a measuring method of the temperature of the heating unit include: a method where a thermocouple is disposed in the heating unit, and a temperature of the heating unit is directly measured; and a method where a temperature of a surrounding area of the heating unit is measured in a non-contact manner by means of a radiation thermometer etc. to determine the measured temperature as a temperature of the heating unit.

In the present disclosure, the following formula $D_{gloss}>D_{matte}$ is preferably satisfied, and the following formula $D_{gloss}-D_{matte}\geq 10\%$ is more preferably satisfied, where $D_{matte}$ is a printing rate of a matte print image to be printed in the matte gloss printing mode, and $D_{gloss}$ is a printing rate of a gloss print image to be printed in the gloss printing mode.

Since a smooth surface is more easily formed at a high printing rate, an image of a high printing rate is printed in the gloss printing mode. Since coalescence of adjacent dots occurs at a high printing rate and it is difficult to form surface irregularities, an image of a low printing rate is printed in the matte gloss printing mode.

Printing rate (%)=the number of printed dots of clear ink/(vertical resolution×horizontal resolution)×100

(in the formula above, "the number of printed dots of clear ink" is the number of dots formed per unit area by actually printing the clear ink, "vertical resolution" and "horizontal resolution" are each resolution per unit area, and in the case where the clear ink is printed to overlap to form dots on the same positions, "the number of printed dots of clear ink" represents the total number of dots formed per unit area by actually printing the clear ink.)

Note that, the printing rate being 100% means the maximum ink weight of a single color relative to a pixel.

<Ink Storage Unit>

The ink storage unit is configured to store an ink.

The ink storage unit is not particularly limited as long as the ink storage unit is a member capable of storing an ink therein. Examples of the ink storage unit include an ink storage container and an ink tank.

The ink storage container includes the ink stored in a container, and may further include other members appropriately selected depending on the necessity.

The container is not particularly limited and a shape, structure, size, and material thereof are appropriately selected depending on the intended purpose. Examples of the container include a container including at least an ink bag formed of an aluminium laminate film, and a resin film.

Examples of the ink tank include a main tank and a sub tank.

<Ejection Head>

The ejection head is configured to eject an ink to form a print layer.

The ejection head includes a nozzle plate, a pressurizing chamber, and a stimulus generating unit.

—Nozzle Plate—

The nozzle plate includes a nozzle substrate, and an ink repellent film disposed on the nozzle substrate.

—Pressurizing Chamber—

The pressurizing chamber is disposed to correspond to each of a plurality of nozzle holes disposed in the nozzle plate. The pressurizing chambers are a plurality of individual flow channel connected to each of the nozzle holes. The pressurizing chamber may be also referred as an ink flow channel, a pressurizing liquid chamber, a pressure chamber, an ejection chamber, or a liquid chamber.

—Stimulus Generating Unit—

The stimulus generating unit is a unit configured to generate stimulus to be applied to an ink.

The stimulus generated by the stimulus generating unit is not particularly limited and may be appropriately selected depending on the intended purpose. Examples of the stimulus include heat (temperature), pressure, vibration, and light. The above-listed examples may be used alone or in combination. Among the above-listed examples, heat and pressure are preferable.

Examples of the stimulus generating unit include a heating device, a pressure device, a piezoelectric element, a vibration generating device, an ultrasonic oscillator, and a light. Specific examples of the stimulus generating unit include: piezoelectric actuators, such as piezoelectric elements; thermal actuators each utilizing a phase change caused by film boiling of an ink using an electrothermal energy conversion element, such as a heat resistor; shape-memory alloy actuators each utilizing a metal phase change due to a temperature change; and electrostatic actuators each utilizing an electrostatic force.

In the case where the stimulus is "heat," thermal energy corresponding to a printing signal is applied to an ink inside the ejection head, for example, by means of a thermal head. Bubbles are formed in the ink by the thermal energy, and the ink is ejected as droplets from the nozzle holes of the nozzle plate by the pressure of the bubbles.

In the case where the stimulus is "pressure," the piezoelectric element is bent by applying voltage to the piezoelectric element bonded to a position, so called, the pressure chamber in an ink flow path of the ejection head. As a result, a volume of the pressure chamber is contracted to eject the ink, as droplets, from the nozzle holes of the ejection head.

Among the above-described examples, a piezo system where an ink is discharged by applying voltage to a piezoelectric element is preferable.

<Heating Step and Heating Unit>

The heating step is a step including heating the printed printing material and is performed by a heating unit.

The heating unit includes a unit configured to heat and dry a printed surface and back surface of a printing material serving as a material to be printed. Examples of the heating unit include an infrared ray heater, a hot air heater, and a heat roller. The above-listed examples may be used alone or in combination.

A method for drying the printing material serving as the material to be printed is not particularly limited and may be appropriately selected depending on the intended purpose. Examples of the method include: a method where the printing material to which the ink has been deposited is brought into contact with a heated fluid, such as hot air as a drying unit; a method where the printing material to which the ink has been deposited is brought into contact with a heating member to heat through heat transfer; and a method where the printing material to which the ink has been deposited is heated by applying energy rays, such as inferred rays and far infrared rays.

The heating may be performed before printing, during printing, after printing, or any combination thereof.

By heating before or during printing, printing can be performed on a heated medium. By heating after printing, printed matter can be dried.

The heating duration is not particularly limited and may be appropriately selected depending on the intended purpose, as long as a surface temperature of the printing material can be controlled to a desired temperature.

The heating duration can be controlled by controlling transferring speed of the printing material serving as the material to be printed.

<Washing Step and Washing Unit>

The washing step is a step including washing a nozzle-formed surface of the ejection head with a washing liquid and is performed by a washing unit. Note that the washing unit may be included in a maintenance recovery system of the inkjet printing device, or may include a maintenance recovery system.

The washing unit includes a washing liquid-applying unit, and a wiping unit.

The washing step includes a washing liquid-applying step, and a wiping step.

—Washing Liquid-Applying Step and Washing Liquid-Applying Unit—

The washing liquid-applying step is a step including applying a washing liquid to a wiping member. For example, the washing liquid-applying step is a step including applying a washing liquid to a wiping member disposed on a pressing member.

The washing liquid-applying unit is a unit configured to applying a washing liquid to a wiping member disposed on a pressing member. For example, the washing liquid-applying unit is a unit configured to apply a washing liquid to a wiping member disposed on a pressing member.

The washing liquid-applying step can be suitably performed by the washing liquid-applying unit.

The pressing member is not particularly limited as long as the pressing member is a member capable of pressing the nozzle-formed surface via the wiping member, and is appropriately selected depending on the intended purpose. Examples of the pressing member include a press roller, a combination of a press roller and a press belt, a wiper, and a blade. Among the above-listed examples, a press roller is preferable.

The washing liquid-applying unit is not particularly limited as long as the washing liquid-applying unit can apply a certain amount of a washing liquid, and may be appropriately selected depending on the intended purpose. Examples of the washing liquid-applying unit include application by a pipette, a nozzle, a spray, a dispenser, and a coating device.

The wiping member is not particularly limited and may be appropriately selected depending on the intended purpose. Examples of the wiping member include a non-woven cloth, and a cloth. Among the above-listed examples, the wiping member wound up in the formed of a roll is preferable, and a non-woven cloth wound up in the form of a roll is preferable in view of high reliability with less dust emission.

An amount of the washing liquid applied is preferably controlled by a recording time (ejection time). In this case, the amount of the washing liquid applied is more preferably selected from a plurality of set values.

Examples of the set values include an application method of the washing liquid (e.g., "pressure," "the number of applications," and "the number of nozzles applied"). Moreover, the amount of the washing liquid applied is preferably controlled by pressure applied to a washing liquid applying nozzle serving as a washing liquid-applying unit. In the case where the washing liquid is applied from a plurality of the washing liquid applying nozzles, the amount of the washing liquid applied to the wiping member is preferably controlled by the number of the washing liquid applying nozzles. Furthermore, the amount of the washing liquid applied to the wiping member is preferably controlled by the number of applications of the washing liquid from the washing liquid applying nozzle.

—Wiping Step and Wiping Unit—

The wiping step is a step including wiping the applied washing liquid with the wiping member. The wiping unit is a unit configured to wipe the applied washing liquid with the wiping member. The wiping step and the wiping unit are preferably to wipe a nozzle surface. The wiping step is suitably performed by the wiping unit.

A method for wiping the nozzle surface with the wiping member to which the washing liquid is applied is not particularly limited and may be appropriately selected depending on the intended purpose. Examples of the method include a method where a non-woven cloth serving as a wiping member to which a washing liquid is applied is pressed against a nozzle surface of an inkjet head by a press roller serving as a pressing member.

<Washing Liquid>

The washing liquid for use in the present disclosure is a washing liquid including water, a compound represented by General Formula (1) below, a glycol ether compound, and a surfactant, where an amount of the glycol ether compound dissolved in 100 g of water of 25 degrees Celsius is greater than 5 g, and an amount of the glycol ether compound is 1% by mass or greater but 30% by mass or less. The washing liquid may further include other ingredients according to the necessity.

[Chem.1]

General Formula (1)

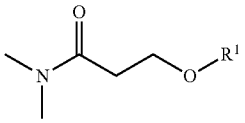

In General Formula (1), $R^1$ is an alkyl group having 1 or more but 4 or less carbon atoms.

A conventional washing liquid including at least one kind of glycol ethers and glycol esters cannot obtain sufficient detergence and has poor storage stability thereof and poor mixing stability with an ink. On the other hand, the washing liquid for use in the present disclosure has excellent mixing stability with an ink, and can perform excellent cleaning.

High detergence can be obtained by using the compound represented by General Formula (1) and the glycol ether compound in combination, compared with single use of the compound represented by General Formula (1) or the glycol ether compound. Even in the case where separation is caused when the glycol ether compound is used alone, moreover, sufficient storage stability can be obtained.

As described, the washing liquid for use in the present disclosure includes water, the compound represented by General Formula (1), a glycol ether compound, and a surfactant, where an amount of the glycol ether compound dissolved in 100 g of water of 25 degrees Celsius is greater than 5 g, and an amount of the glycol ether compound is 1% by mass or greater but 30% by mass or less.

<<Compound Represented by General Formula (1)>>

[Chem.2]

General Formula (1)

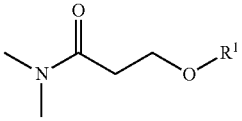

In General Formula (1), $R^1$ is an alkyl group having 1 or more but 4 or less carbon atoms.

In General Formula (1), $R^1$ is an alkyl group having 1 or more but 4 or less carbon atoms. Examples thereof include a methyl group, an ethyl group, a propyl group, and a butyl group. Among the above-listed examples, a methyl group, an ethyl group, and a butyl group are preferable, and a methyl group and a t-butyl group are more preferable. Examples of the compound represented by General Formula (1) include 3-methoxy-N,N-dimethylpropionamide (when $R^1$ in General Formula (1) is a methyl group), and 3-butoxy-N,N-dimethylpropionamide (where $R^1$ in General Formula (1) is a butyl group).

The compound represented by General Formula (1) may be appropriately synthesized for use or selected from commercial products. Examples of the commercial products include 3-methoxy-N,N-dimethylpropionamide (Equamide M100, available from Idemitsu Kosan Co., Ltd.), and 3-butoxy-N,N-dimethylpropionamide (Equamide B100, available from Idemitsu Kosan Co., Ltd.).

The 3-methoxy-N,N-dimethylpropionamide can be synthesized in the following manner. A 300 mL separable flask equipped with a stirrer, a thermocouple, and a nitrogen gas inlet tube is charged with 19.828 g of N,N-dimethylacrylamide, and 19.868 g of ethanol, and the resultant mixture is stirred with introducing nitrogen gas into the flask.

Subsequently, 0.338 g of sodium-methoxide is added, and the resultant is allowed to react for 4 hours at 35 degrees Celsius. After completing the reaction, 150 mg of phosphoric acid is added and the resultant solution is made homogeneous, followed by leaving the solution to stand for 3 hours. The obtained solution was filtered to remove precipitates, and unreacted products are removed by an evaporator to thereby synthesize 3-methoxy-N,N-dimethylpropionamide.

The 3-butoxy-N,N-dimethylpropionamide can be synthesized in the following manner. A 300 mL separable flask equipped with a stirrer, a thermocouple, and a nitrogen gas inlet tube is charged with 19.828 g of N,N-dimethylacrylamide, and 19.868 g of ethanol, and the resultant mixture is stirred with introducing nitrogen gas into the flask.

Subsequently, 0.338 g of sodium-butoxide is added, and the resultant is allowed to react for 4 hours at 35 degrees Celsius. After completing the reaction, 150 mg of phosphoric acid is added and the resultant solution is made homogeneous, followed by leaving the solution to stand for 3 hours. The obtained solution was filtered to remove precipitates, and unreacted products are removed by an evaporator to thereby synthesize 3-butoxy-N,N-dimethylpropionamide.

An amount of the compound represented by General Formula (1) is preferably 10% by mass or greater but 60% by mass or less, more preferably 20% by mass or greater but 50% by mass or less relative to a total amount of the washing liquid. When the amount thereof is 10% by mass or greater but 60% by mass or less, all of detergence, ejection stability, and storage stability can be achieved.

<<Glycol Ether Compound>>

The glycol ether compound has a strong force that functions on an ink film and can improve detergence. When a combination of the compound represented by General Formula (1) and the glycol ether compound are included in the washing liquid, all of detergence, ejection stability, and storage stability can be achieved.

The glycol ether compound is not particularly limited as long as the glycol ether compound is a glycol ether compound an amount of which dissolved in 100 g of water of 25 degrees Celsius is greater than 5 g, and may be appropriately selected depending on the intended purpose. Examples of the glycol ether compound include ethylene glycol monobutyl ether, propylene glycol monomethyl ether, propylene glycol monobutyl ether, diethylene glycol monoethyl ether, diethylene glycol monobutyl ether, diethylene glycol methylethyl ether, dipropylene glycol monomethyl ether, dipropylene glycol monoethyl ether, propylene glycol-n-propyl ether, triethylene glycol monomethyl ether, triethylene glycol monoethyl ether, triethylene glycol monobutyl ether, tripropylene glycol monomethyl ether, and a dialkyl glycol ether compound represented by General Formula (2) below. The above-listed examples may be used alone or in combination. Among the above-listed examples, a dialkyl glycol ether compound represented by General Formula (2) below is particularly preferable because the dialkyl glycol ether compound can easily soften dirt and detergence can be improved.

[Chem.3]

General Formula (2)

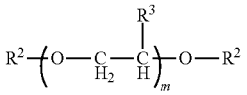

In General Formula (2), $R^2$ is $C_nH_{2n+1}$ where n is from 1 through 4, $R^3$ is a hydrogen atom or a methyl group, and m is an integer of from 1 through 4.

Examples of the dialkyl glycol ether compound represented by General Formula (2) include diethylene glycol dimethyl ether, diethylene glycol diethyl ether, diethylene glycol dibutyl ether, tetraethylene glycol dimethyl ether, and tetraethylene glycol diethyl ether.

An amount of the glycol ether compound an amount of which dissolved in 100 g of water of 25 degrees Celsius is greater than 5 g is 1% by mass or greater but 30% by mass or less, and preferably 1% by mass or greater but 10% by mass or less, relative to a total amount of the washing liquid. When the amount thereof is 1% by mass or greater but 30% by mass or less, all of detergence, ejection stability, and storage stability can be achieved.

<<Glycol Ether Compound Amount of which Dissolved in 100 g of Water of 25 Degrees Celsius is 5 g or Less>>

The washing liquid preferably further includes a glycol ether compound an amount of which dissolved in 100 g of water of 25 degrees Celsius is 5 g or less.

Since the washing liquid includes the glycol ether compound an amount of which dissolved in 100 g of water of 25 degrees Celsius is 5 g or less, the washing liquid can also act on hydrophobic dirt, the detergent force acting on an ink film having a high resin content can be made string, and therefore detergence is improved.

Particularly, use of the glycol ether compound an amount of which dissolved in 100 g of water of 25 degrees Celsius is 5 g or less and the dialkyl glycol ether compound represented by General Formula (2) in combination is preferable as an unexpected effect of detergence can be obtained.

Examples of the glycol ether compound an amount of which dissolved in 100 g of water of 25 degrees Celsius is 5 g or less include dipropylene glycol-n-butyl ether, tripropylene glycol-n-butyl ether, and propylene glycol phenyl ether.

An amount of the glycol ether compound an amount of which dissolved in 100 g of water of 25 degrees Celsius is 5 g or less is preferably 1% by mass or greater but 20% by mass or less, more preferably 1% by mass or greater but 10% by mass or less, relative to a total amount of the washing liquid. When the amount thereof is 1% by mass or greater, detergence improves. When the amount thereof is 20% by mass or less, a mixing stability with an ink improves.

In the present disclosure, the washing liquid may include other solvents, in addition to the compound represented by General Formula (1) and the glycol ether, as long as the solvents to be included do not impair an obtainable effect of the present disclosure.

The above-mentioned other solvents are not particularly and may be appropriately selected depending on the intended purpose. Examples thereof include water-soluble organic solvents.

The water-soluble organic solvents are not particularly limited and may be appropriately selected depending on the intended purpose. Examples of the water-soluble organic solvents include polyvalent alcohols, nitrogen-containing heterocyclic compounds, amides, amines, sulfur-containing compounds, propylene carbonate, ethylene carbonate, and polyol compounds having 8 or more carbon atoms. The above-listed examples may be used alone or in combination.

Examples of the polyvalent alcohols include ethylene glycol, diethylene glycol, 1,2-propanediol, 1,3-propanediol, 1,2-butanediol, 1,3-butanediol, 1,4-butanediol, 2,3-butanediol, 3-methyl-1,3-butanediol, triethylene glycol, polyethylene glycol, polypropyleneglycol, 1,2-pentanediol, 1,3-pentanediol, 1,4-pentanediol, 2,4-pentanediol, 1,5-pentanediol, 1,2-hexanediol, 1,6-hexanediol, 1,3-hexanediol, 2,5-hexanediol, 1,5-hexanediol, glycerin, 1,2,6-hexanetriol, 2-ethyl-1,3-hexanediol, ethyl-1,2,4-butanetriol, 1,2,3-butanetriol, 2,2,4-trimethyl-1,3-pentanediol, and petriol.

Examples of the nitrogen-containing heterocyclic compounds include 2-pyrolidone, N-methyl-2-pyrolidone, N-hydroxyethyl-2-pyrolidone, 1,3-dimethyl-2-imidazolidinone, epsilon-caprolactam, and gamma-butyrolactone.

Examples of the amides include formamide, N-methylformamide, N,N-dimethylformamide, 3-methoxy-N,N-dimethylpropionamide, and 3-butoxy-N,N-dimethylpropionamide.

Examples of the amines include monoethanolamine, diethanolamine, and triethylamine.

Examples of the sulfur-containing compounds include dimethylsulfoxide, sulfolane, and thiodiethanol.

Examples of the polyol compounds having 8 or more carbon atoms include 2-ethyl-1,3-hexanediol, and 2,2,4-trimethyl-1,3-pentanediol.

<<Surfactant>>

As a surfactant, any of polyoxyalkylene surfactants, silicone surfactants, fluorosurfactants, amphoteric surfactants, nonionic surfactants, and anionic surfactants can be used. Among the above-listed examples, polyoxyalkylene surfactants and silicone surfactants are preferable, and polyoxyalkylene surfactants are particularly preferable in view of detergence and storage stability.

Examples of the polyoxyalkylene surfactants include polyoxyethylene distyrenated phenyl ether, and polyoxyethylene polyoxypropylene alkyl ether.

The polyoxyalkylene surfactants may be appropriately synthesized for use or selected from commercial products. Examples of the commercial products include EMULGEN A-60 (polyoxyethylene distyrenated phenyl ether), EMULGEN LS-106 (polyoxyethylene polyoxypropylene alkyl ether), and EMULGEN LS-110 (polyoxyethylene polyoxypropylene alkyl ether) (all higher alcohol ether nonionic surfactants, available from Kao Corporation). The above-listed examples may be used alone or in combination.

The silicone surfactants are not particularly limited and may be appropriately selected depending on the intended purpose. Examples thereof include sidechain-modified polydimethylsiloxane, both end-modified polydimethylsiloxane, one-end-modified polydimethylsiloxane, and side-chain-both-end-modified polydimethylsiloxane. Among them, a polyether-modified silicone surfactant including, as a modifying group, a polyoxyethylene group or polyoxyethylene polyoxypropylene group is particularly preferable because such a surfactant has excellent properties as an aqueous surfactant.

As the silicone surfactant, moreover, a polyether-modified silicone surfactant may be used. Examples thereof include a compound in which a polyalkylene oxide structure is introduced into a side chain of the Si site of dimethylsiloxane.

The above-listed surfactants may be appropriately synthesized for use, or selected from commercial products. For example, the commercial products can be obtained from BYK Japan KK, Shin-Etsu Chemical Co., Ltd., Dow Corning Toray Co., Ltd., NIHON EMULSION Co., Ltd., Kyoeisha Chemical Co., Ltd., etc.

The polyether-modified silicone surfactants are not particularly limited and may be appropriately selected depending on the intended purpose. Examples thereof include a compound represented by General Formula (S-1) below, where a polyalkylene oxide structure is introduced into a side chain of the Si site of dimethylpolysiloxane.

[Chem.4]

General Formula (S-1)

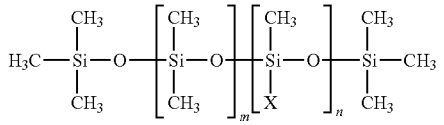

$X = —R(C_2H_4O)_a(C_3H_6O)_bR'$

In General Formula (S-1), m, n, a, and b are each independently an integer, R is an alkylene group, and R' is an alkyl group.

As the polyether-modified silicone surfactant, a commercial product can be used. Examples thereof include: KF-618, KF-642, and KF-643 (available from Shin-Etsu Chemical Co., Ltd.); EMALEX-SS-5602, and SS-1906EX (available from NIHON EMULSION Co., Ltd.); FZ-2105, FZ-2118, FZ-2154, FZ-2161, FZ-2162, FZ-2163, and FZ-2164 (available from Dow Corning Toray Co., Ltd.); BYK-33, and BYK-387 (available from BYK Japan KK); and TSF4440, TSF4452, and TSF4453 (available from Momentive Performance Materials LLC).

As the fluorosurfactants, for example, perfluoroalkyl sulfonic acid compounds, perfluoroalkyl carboxylic acid compounds, perfluoroalkyl phosphoric acid ester compounds, perfluoroalkyl ethylene oxide adducts, and polyoxyalkylene ether polymer compounds having a perfluoroalkyl ether group in a side chain thereof are particularly preferable because the above-listed surfactants have low foamability. Examples of the perfluoroalkyl sulfonic acid compounds include perfluoroalkyl sulfonic acid, and perfluoroalkyl sulfonic acid salts. Examples of the perfluoroalkyl carboxylic acid compounds include perfluoroalkyl carboxylic acid, and perfluoroalkyl carboxylic acid salts. Examples of the polyoxyalkylene ether polymer compounds having a perfluoroalkyl ether group in a side chain thereof include sulfuric acid ester salts of polyoxyalkylene ether polymer having a perfluoroalkyl ether group in its side chain and salts of polyoxyalkylene ether polymers having a perfluoroalkyl ether group in its side chain. Examples of counter ions of salts in the fluorosurfactants include Li, Na, K, $NH_4$, $NH_3CH_2CH_2OH$, $NH_2(CH_2CH_2OH)_2$, and $NH(CH_2CH_2OH)_3$.

Examples of the amphoteric surfactants include lauryl aminopropionic acid salts, lauryl dimethyl betaine, stearyl dimethyl betaine, and lauryl dihydroxyethyl betaine.

Examples of the nonionic surfactants include polyoxyethylene alkyl phenyl ether, polyoxyethylene alkyl ester, polyoxyethylene alkyl amine, polyoxyethylene alkyl amide, polyoxyethylene propylene block polymers, sorbitan fatty acid esters, polyoxyethylene sorbitan fatty acid esters, and ethylene oxide adducts of acetylene alcohol.

Examples of the anionic surfactants include polyoxyethylenealkyl ether acetate, dodecyl benzene sulfonate, laurate, and polyoxyethylene alkyl ether sulfate.

The above-listed examples may be used alone or in combination.

An amount of the surfactant is not particularly limited and may be appropriately selected depending on the intended purpose without any limitation. In view of excellent wettability and ejection stability and improvement of image quality, the amount thereof is preferably 0.001% by mass or greater but 5% by mass or less, more preferably 0.05% by mass or greater but 5% by mass or less, and even more preferably 0.1% by mass or greater but 3% by mass or less.

<<Water>>

An amount of the water is not particularly limited and may be appropriately selected depending on the intended purpose. The amount of the water is preferably 10% by mass or greater but 80% by mass or less, more preferably 10% by mass or greater but 60% by mass or less, and particularly preferably 10% by mass or greater but 59% by mass or less, relative to a total amount of the washing liquid. When the amount thereof is 10% by mass or less, ink deposits on an interface of the nozzle-formed surface can be cleanly wiped out and sufficient ejection reliability can be obtained. When the amount thereof is 80% by mass or less, the ink deposits can be sufficiently swollen. Moreover, a flash point can be eliminated by adding water.

<<Other Ingredients>>

The above-mentioned other ingredients are not particularly limited and may be appropriately selected depending on the intended purpose. Examples thereof include a defoaming agent, a preservative and fungicide, a corrosion inhibitor, and a pH regulator.

—Defoaming Agent—

The defoaming agent is not particularly limited. Examples thereof include silicone-based defoaming agents, polyether-based defoaming agents, and fatty acid ester-based defoaming agent. The above-listed examples may be used alone or in combination.

Among the above-listed examples, silicone-based defoaming agents are preferable because the silicone-based defoaming agents have an excellent defoaming effect.

—Preservatives and Fungicides—

The preservatives and fungicides are not particularly limited. Examples thereof include 1,2-benzoisothiazolin-3-one.

—Corrosion Inhibitor—

The corrosion inhibitor is not particularly limited. Examples thereof include acid sulfite and sodium thiosulfate.

—pH Regulator—

The pH regulator is not particularly limited as long as the pH regulator can adjust pH to 7 or higher. Examples thereof include amines, such as diethanolamine, and triethanol amine.

The washing liquid for use in the present disclosure is used when a nozzle surface of an ink ejection head of an inkjet printing device is wiped. As a usage method of the washing liquid, the washing liquid may be used by applying the washing liquid to a wiping member, or spraying the washing liquid on the nozzle surface followed by wiping with the wiping member.

An image forming apparatus including the washing unit of the present disclosure will be described.

FIG. 3 is a schematic view illustrating an example of an image forming apparatus including a washing unit, where the image forming apparatus is equipped with a serial type droplet ejection device. The image forming apparatus will be described with reference to FIGS. 3 to 5.

A carriage 3 is movably held with a main guide member 1 and a sub guide member which are laterally bridged to left and right side plates. The carriage 3 is driven reciprocately in a main-scanning direction (carriage travel direction) by a main scanning motor 5 via a timing belt 8 supported by a drive pulley 6 and an idler pulley 7.

Recording heads 4*a* and 4*b* (merely referred to as a "recording head 4" when they are not distinguished) each formed of a liquid ejection head are mounted in the carriage 3. For example, the recording head 4 ejects ink droplets of each color, e.g., yellow (Y), cyan (C), magenta (M), or black (K). Moreover, the recording head 4 includes a nozzle array 4*n* formed of a plurality of nozzles arranged in a sub-scanning direction orthogonal to the main-scanning direction, and the recording head 4 is mounted in a manner that a droplet ejection direction faces downwards.

As illustrated in FIG. 4, the recording head 4 includes two nozzle arrays Na and Nb in each of which a plurality of nozzle arrays 4*n* are arranged.

As the liquid ejection head constituting the recording head 4, for example, a piezoelectric actuator (e.g., a piezoelectric element) or a thermal actuator using a phase change due to film boiling of a liquid using a thermoelectric conversion element (e.g., a heat resistor) can be used.

In order to transport sheets 10, disposed is a conveyor belt 12 configured to electrostatically attract a sheet to transport to a position facing the recording head 4. The conveyor belt 12 is an endless belt, and is supported between a conveying roller 13 and a tension roller 14.

The conveyor belt 12 is rotated in the sub-scanning direction by rotationally drying the conveying roller 13 by a sub-scanning motor 16 via the timing belt 17 and a timing pulley 18. The conveyor belt 12 is charged (applied with charge) by a charging roller while the conveyor belt 12 rotates.

At one side of the main-scanning direction of the carriage 3, a maintenance recovery mechanism 20 including a washing unit configured to perform maintenance and recovery of the recording head 4 is disposed at the side of the conveyor belt 12. At the other side of the main-scanning direction of the carriage 3, an idle ejection receiver 21 to which the recording head 4 performs idle ejection at the side of the conveyor belt 12.

For example, the maintenance recovery mechanism 20 includes a cap member 20*a* configured to cap a nozzle-formed surface (surface to which nozzles are formed) of the recording head 4, a washing unit 20*b* configured to wipe the nozzle-formed surface, and the idle ejection receiver to which droplets not contributing to image formation are ejected.

Moreover, an encoder scale 23 having a certain pattern is disposed horizontally between the side plates of both sides along the main-scanning direction of the carriage 3, and an encoder sensor 24 formed of a transmission photosensor configured to read the pattern of the encoder scale 23 is disposed in the carriage 3. The encoder scale 23 and encoder scale 24 constitute a linear encoder (main scanning encoder) configured to detect the movement of the carriage 3.

Moreover, a code wheel 25 is attached to an axis of the conveying roller 13, and an encoder sensor 26 formed of a transmission photosensor configured to detect the pattern formed in the code wheel 25 is disposed. The code wheel 25 and encoder sensor 26 constitute a rotary encoder (sub-scanning encoder) configured to detect an amount of movement and moving position of the conveyor belt 12.

In the image forming apparatus constructed in the above-described manner, a sheet 10 is fed from a paper feeding tray onto the charged conveyor belt 12 and electrostatically attracted thereon, and the sheet 10 is transported in the sub-scanning direction by the rotation of the conveyor belt 12.

The recording head 4 is driven according to the image signal while the carriage 3 is moved in the main-scanning direction, and ink droplets are ejected on the stopped sheet 10 to record for 1 line. Then, the sheet 10 is transported by the predetermined distance, followed by recording for a next line.

The recording operation is terminated by receiving a recording termination signal or a signal informing that a rear end of the sheet 10 reaches a recording region, and then the sheet 10 is ejected on the paper ejection tray.

When cleaning of the recording head 4 is performed, moreover, the carriage 3 is moved to the maintenance recovery mechanism 20 during standing by for printing (recording), and then cleaning is performed by the maintenance recovery mechanism 20 including a washing unit. Moreover, the recording head 4 may be cleaned with moving the maintenance recovery mechanism 20 without moving the recording head 4.

The recording head 4 illustrated in FIG. 3 includes two nozzle arrays Na and Nb in each of which a plurality of nozzle arrays 4*a* are aligned as illustrated in FIG. 4. One nozzle array Na of the recording head 4*a* ejects droplets of black (K), and the other nozzle array Nb ejects droplets of cyan (C). One nozzle array Na of the recording head 4*b* ejects droplets of magenta (M), and the other nozzle array Nb ejects droplets of yellow (Y).

As illustrated in FIG. 5, the washing unit 20*b* includes mainly a wiping member 320 in the form of a sheet, a roller 510 to send the wiping member in the form of a sheet, a press roller 520 configured to press the sent wiping member 320 against the nozzle-formed surface, and a winding roller 530 configured to collect the wiping member 320 used for wiping. In addition to the wiping member in the form of a sheet, moreover, the washing unit 20*b* may include a rubber blade for wiping the nozzle-formed surface, etc. The press roller 520 uses a spring, and press force of the press roller 520 can be adjusted by adjusting a distance between the washing unit and the nozzle-formed surface. The press member is not limited to a roller, and may be a fixed member formed of a resin or rubber. In the case where the rubber blade etc. is disposed, a cleaning function of a rubber blade etc., may be imparted to the wiping member in the form of a sheet by disposing a mechanism where the rubber blade etc. is brought into contact with the wiping member in the form of a sheet.

After applying the predetermined amount of the washing liquid to the wiping member 320, the cleaning unit and the head are relatively moved while pressing the wiping member 320 against the nozzle-formed surface to wipe foreign matter 500 deposited on the nozzle-formed surface. Examples of the foreign matter 500 deposited on the nozzle-formed surface include a mist ink generated when the ink is ejected from the nozzle, the ink deposited when the ink is suctioned from the nozzle by cleaning etc., the adhered ink generated by drying, on the nozzle-formed surface, the mist ink or the ink deposited on the capping member. The washing liquid may be applied to the wiping member in advance.

FIG. 6 is a schematic view illustrating another example of the washing unit in the inkjet printing device of the present disclosure. The washing unit 300 of FIG. 6 is a device configured to wash the ink ejection side of a nozzle surface 301*a* of the nozzle plate 301 of the ink ejection head.

The washing unit 300 includes a non-woven cloth 303 serving as a wiping member, a washing liquid applying nozzle 302 serving as a washing liquid-applying unit, a press roller 305 serving as a pressing member, and a winding roller 304 configured to wind up the non-woven cloth after the wiping process.

The washing liquid is supplied from a washing liquid tank via a washing liquid supply tube, which is not illustrated. The washing liquid is applied in the application amount according to a recording time to the non-woven cloth 303 serving as a wiping member from the washing liquid applying nozzle 302 by driving a pump disposed in the middle of the washing liquid supply tube. Note that, the non-woven cloth 303 is wound up in the form of a roll.

As illustrated in FIG. 6, the non-woven cloth 303 to which the washing liquid is applied is brought into contact with and pressed against the nozzle surface 301*a* of the ink ejection head by the press roller 305 serving as the pressing member, to thereby clean the nozzle surface 301*a*. After completing the wiping process, the non-woven cloth 303 is wound up in the winding roller 304.

A plurality of the washing liquid applying nozzles 302 each serving as the washing liquid-applying unit may be disposed. The pressure is applied to each washing liquid applying nozzle 302 based on the control performed by the controlling unit (not illustrated). The application amount of the washing liquid can be adjusted by appropriately changing the pressure. Moreover, the application amount of the washing liquid can be adjusted by changing the number of nozzles to which the washing liquid is applied based on the control performed by the controlling unit (not illustrated). Furthermore, the application amount of the washing liquid can be adjusted by changing the number of times the washing liquid is applied based on the control performed by the controlling unit (not illustrated).

As described above, the nozzle surface may be wiped using the wiping member, to which the washing liquid is applied, during or after recording.

The example where the non-woven cloth 303 immersed in the washing liquid is described above. However, the nozzle surface 301*a* may be wiped by allowing the washing liquid to contact with the nozzle surface 301*a* by a spray etc. (not illustrated), and the nozzle surface 301*a* may be wiped with the non-woven cloth 303.

<Ink>

A clear ink is used as an ink. The clear ink means a colorless transparent ink that is substantially free from a colorant.

As the clear ink, there are a water-based clear ink and a solvent-based clear ink. In the present disclosure, the clear ink includes both a water-based ink and a solvent-based ink. Both inks are collectively referred to as a clear ink hereinafter.

The clear ink includes a resin, and preferably further includes a solvent or water. The solvent and water may be used in combination in the clear ink. The clear ink may further include other ingredients according to the necessity.

<<Water>>

The water is not particularly limited and may be appropriately selected depending on the intended purpose. Examples of the water include pure water, such as ion-exchanged water, ultrafiltration water, reverse osmosis-filtered water, distilled water, and ultrapure water. The above-listed examples may be used alone or in combination.

An amount of the water is not particularly limited. When the clear ink is used as a water-based clear ink, the amount of the water may be 0.1% by mass or greater but 80% by mass or less relative to a total amount of the clear ink, and is preferably 15% by mass or greater but 60% by mass or less. When the amount of the water is 15% by mass or greater, the clear ink is prevented from having high viscosity, and ejection stability thereof can be improved. When the amount of the water is 60% by mass or less, wettability to a non-permeable printing material is excellent and image quality can be improved.

<<Organic Solvent>>

The clear ink may include an organic solvent. The organic solvent is not particularly limited and may be appropriately selected depending on the intended purpose. Examples of the organic solvent include water-soluble organic solvents. The "water-soluble" organic solvent means, for example, that 5 g or greater of the organic solvent dissolves in 100 g of water of 25 degrees Celsius.

Specific examples of the water-soluble organic solvents include, but are not limited to, polyol such as ethylene glycol, diethylene glycol, 1,2-propanediol, 1,3-propanediol, 1,2-butanediol, 1,3-butanediol, 2,3-butanediol, 3-methyl-1,3-butanediol, 3-methoxy-3-methylbutanol, triethylene glycol, polyethylene glycol, polypropyleneglycol, 1,5-pentanediol, 2-methyl-2,4-pentanediol, 1,6-hexanediol, glycerin, 1,2,6-hexanetriol, 2-ethyl-1,3-hexanediol, ethyl1,2,4-butanetriol, 1,2,3-butanetriol, and petriol; polyol alkylethers such as ethylene glycol monoethylether, ethylene glycol monobutylether, diethylene glycol monomethylether, diethylene glycol monoethylether, diethylene glycol monobutylether, tetraethylene glycol monomethylether, propylene glycol monoethylether, and dipropylene glycol monomethylether; polyol arylethers, such as ethylene glycol monophenyl ether, and ethylene glycol monobenzylethers;

nitrogen-containing heterocyclic compounds such as 2-pyrolidone, N-methyl-2-pyrolidone, N-hydroxyethyl-2-pyrolidone, 1,3-dimethylimidazolidinone, epsilon-caprolactam, and gamma-butyrolactone; amides such as formamide, N-methylformamide, and N,N-dimethylformamide; amines such as monoethanolamine, diethanolamine, and triethylamine; sulfur-containing compounds such as dimethyl sulfoxide, sulfolane, and thiodiethanol; propylene carbonate, and ethylene carbonate. The above-listed examples may be used alone or in combination.

The proportion of the organic solvent in the clear ink has no particular limit and can be suitably selected to suit a particular application. In terms of the drying property and discharging reliability of the ink, the proportion is preferably 10% by mass or greater but 60% by mass or less and more preferably 20% by mass or greater but 60% by mass or less.

<<Resin>>

The resin is not particularly limited and may be appropriately selected depending on the intended purpose. Examples of the resin include a polyurethane resin, a polyester resin, an acrylic resin, a vinyl acetate-based resin, a styrene resin, a butadiene resin, a styrene-butadiene resin, a vinyl chloride resin, an acryl-styrene resin, and an acryl-silicone resin.

When an ink is produced, resin particles formed of any of the above-listed resins are preferably added. The resin particles may be added to the ink in a state of a resin emulsion in which the resin particles are dispersed using water as a dispersion medium. As the resin particles, resin particles appropriately synthesized may be used, or a commercial product may be used. The above-listed examples may be used alone or in combination. Among the above-listed examples, a polyurethane resin is preferable. When an ink film is formed using a clear ink, toughness of the coating film is increased by adding the polyurethane resin. The addition of the polyurethane resin is preferable because partial peeling of the coating film due to breakage inside the coating film, or a change of a color of the friction area due to a change in a surface state of the coating film.

—Polyurethane Resin—

Examples of the polyurethane resin include a polyether-based polyurethane resin, a polycarbonate-based polyurethane resin, and a polyester-based polyurethane resin.

The polyurethane resin is not particularly limited and may be appropriately selected depending on the intended purpose. Examples of the polyurethane resin obtained through a reaction between polyol and polyisocyanate.

—Polyol—

Examples of the polyol include polyether polyol, polycarbonate polyol, and polyester polyol. The above-listed examples may be used alone or in combination.

—Polyether Polyol—

Examples of the polyether polyol include polyether polyol obtained by addition polymerization of alkylene oxide using at least one compound including 2 or more active hydrogen atoms as a starting material.

Examples of the compound including 2 or more active hydrogen atoms include ethylene glycol, diethylene glycol, triethylene glycol, propylene glycol, trimethylene glycol, 1,3-butanediol, 1,4-butanediol, 1,6-hexanediol, glycerin, trimethylol ethane, and trimethylol propane. The above-listed examples may be used alone or in combination.

Examples of the alkylene oxide include ethylene oxide, propylene oxide, butylene oxide, styrene oxide, epichlorohydrin, and tetrahydrofuran. The above-listed examples may be used alone or in combination.

The polyether polyol is not particularly limited and may be appropriately selected depending on the intended purpose. In view of formation of a binder for an ink capable of imparting extremely excellent abrasion resistance, polyoxytetramethylene glycol and polyoxypropylene glycol are preferable. The above-listed examples may be used alone or in combination.

—Polycarbonate Polyol—

Moreover, examples of the polycarbonate polyol used for production of the polyurethane resin include polycarbonate polyol obtained through a reaction between carbonic acid ester and polyol, and polycarbonate polyol obtained through a reaction between phosgene and bisphenol A. The above-listed examples may be used alone or in combination.

Examples of the carbonic acid ester include methyl carbonate, dimethyl carbonate, ethyl carbonate, diethyl carbonate, cyclocarbonate, and diphenyl carbonate. The above-listed examples may be used alone or in combination.

Examples of the polyol include: dihydroxy compounds of relatively low molecular weight, such as ethylene glycol, diethylene glycol, triethylene glycol, 1,2-propylene glycol, 1,3-propylene glycol, dipropylene glycol, 1,4-butanediol, 1,3-butanediol, 1,2-butanediol, 2,3-butanediol, 1,5-pentanediol, 1,5-hexanediol, 2,5-hexanediol, 1,6-hexanediol, 1,7-heptanediol, 1,8-octanediol, 1,9-nonanediol, 1,10-decanediol, 1,11-undecanediol, 1,12-dodecanediol, 1,4-cyclohexanediol, 1,4-cyclohexanedimethanol, hydroquinone, resorcinol, bisphenol-A, bisphenol-F, and 4,4'-biphenol; polyether polyol, such as polyethylene glycol, polypropylene glycol, and polyoxytetramethylene glycol; and polyester polyol, such as polyhexamethylene adipate, polyhexamethylene succinate, and polycaprolactone. The above-listed examples may be used alone or in combination.

—Polyester Polyol—

Examples of the polyester polyol include polyester polyol obtained through an esterification reaction between low molecular weight polyol and polycarboxylic acid, polyester obtained through a ring-opening polymerization reaction of a cyclic ester compound, such as epsilon-caprolactone, and copolymer polyester thereof. The above-listed examples may be used alone or in combination.

Examples of the low molecular weight polyol include ethylene glycol, and propylene glycol. The above-listed examples may be used alone or in combination.

Examples of the polycarboxylic acid include succinic acid, adipic acid, sebacic acid, dodecane dicarboxylic acid, terephthalic acid, isophthalic acid, phthalic acid, anhydrides thereof, and ester-formable derivatives thereof. The above-listed examples may be used alone or in combination.

—Polyisocyanate—

Examples of the polyisocyanate include: aromatic diisocyanate, such as phenylene diisocyanate, tolylene diisocyanate, diphenylmethane diisocyanate, and naphthalene diisocyanate; and aliphatic or alicyclic diisocyanate, such as hexamethylene diisocyanate, lysine diisocyanate, cyclohexane diisocyanate, isophorone diisocyanate, dicyclohexylmethane diisocyanate, xylene diisocyanate, tetramethylxylene diisocyanate, and 2,2,4-trimethylhexamethylene diisocyanate. The above-listed examples may be used alone or in combination. Among the above-listed examples, alicyclic diisocyanate is preferable in view of weather resistance.

Moreover, intended coating film strength and abrasion resistance can be easily obtained by using at least one kind of alicyclic diisocyanate.

Examples of the alicyclic diisocyanate include isophorone diisocyanate, and dicyclohexylmethane diisocyanate.

An amount of the alicyclic diisocyanate is preferably 60% by mass or greater relative to a total amount of the isocyanate compound.

(Production Method of Polyurethane Resin)

The polyurethane resin is not particularly limited and can be obtained by any of production methods typically used in the art. Examples of the production method thereof include the following method.

First, the polyol and the polyisocyante are allowed to react at an equivalent ratio with which isocyanate groups are excessive without a solvent or in the presence of an organic solvent, to thereby produce a urethane prepolymer including an isocyanate terminal.

Subsequently, anionic groups in the urethane prepolymer including isocyanate terminal are neutralized by a neutralizer. Thereafter, the prepolymer is allowed to react with a chain extender, followed by optionally removing the organic solvent, to thereby obtain a polyurethane resin.

Examples of the organic solvent that can be used for the production of the polyurethane resin include: ketones, such as acetone, and methyl ethyl ketone; ethers, such as tetrahydrofuran and dioxane; acetic acid esters, such as ethyl acetate, and butyl acetate; nitriles, such as acetonitrile; and amides, such as dimethylformamide, N-methylpyrrolidone, and N-ethylpyrrolidone. The above-listed examples may be used alone or in combination.

Examples of the chain extender include polyamine and other active hydrogen group-containing compounds.

Examples of the polyamine include: diamines, such as ethylenediamine, 1,2-propanediamine, 1,6-hexamethylenediamine, piperazine, 2,5-dimethylpiperazine, isophoronediamine, 4,4'-dicyclohexylmethanediamine, and 1,4-cyclohexanediamine; polyamine, such as diethylenetriamine, dipropylenetriamine, and triethylenetetramine; hydrazines, such as hydrazine, N,N'-dimethylhydrazine, and 1,6-hexamethylenebishydrazine; and succinic dihydrazide, adipic dihydrazide, glutaric dihydrazide, sebacic dihydrazide, and isophthalic dihydrazide. The above-listed examples may be used alone or in combination.

Examples of the other active hydrogen group-containing compound include: glycols, such as ethylene glycol, diethylene glycol, triethylene glycol, propylene glycol, 1,3-propanediol, 1,3-butanediol, 1,4-butanediol, hexamethylene glycol, saccharose, methylene glycol, glycerin, and sorbitol; phenols, such as bisphenol A, 4,4'-dihydroxydiphenyl, 4,4'-dihydroxydiphenyl ether, 4,4'-dihydroxydiphenylsulfone, hydrogenated bisphenol A, and hydroquinone; and water. The above-listed examples may be used alone or in combination.

The polyurethane resin is preferably a polycarbonate-based polyurethane resin in view of water resistance owing to high aggregation force of carbonate groups, heat resistance, abrasion resistance, weather resistance, and abrasion resistance of an image. When the polycarbonate-based polyurethane resin is used, an ink suitable for printed matter used in a severe environment, such as outdoor use can be obtained.

As the polyurethane resin, a commercial product may be used. Examples of the commercial product thereof include UCOAT UX-485 (polycarbonate-based polyurethane resin), UCOAT UWS-145 (polyester-based polyurethane resin), PERMARIN UA-368T (polycarbonate-based polyurethane resin), and PERMARIN UA-200 (polyether-based polyurethane resin) (all available from Sanyo Chemical Industries, Ltd.). The above-listed examples may be used alone or in combination.

An amount of the resin included in the clear ink is preferably 8.0% by mass or greater, more preferably 8.0% by mass or greater but 25% by mass or less. When the amount of the resin is 8.0% by mass or greater, matt gloss and gloss can be controlled with a small amount of the clear ink. When the amount of the resin is 25% by mass or less, excellent ejection stability of the clear ink is obtained and therefore use of the resin in such an amount is preferable.

Matte gloss is achieved by forming individual dots each having a large height of a dot sphere (pile height), and imparting irregularities to a surface.

When an amount of the resin in the clear ink is large, dots having high pile heights are easily formed and matte glossiness is easily imparted. Therefore, use of a large amount of the resin in the clear ink is preferable.

On the other hand, gloss is achieved by filling the irregularities of a surface with a clear ink to form a smooth surface to impart smoothness. In order to fill the irregularities of the surface with the clear ink, use of a large amount of the resin in the clear ink is preferable because the irregularities of the surface can be filled with a small amount of the clear ink and gloss is easily imparted.

<Surfactant>

The clear ink preferably includes a surfactant.

When the surfactant is added to the ink, the surface tension of the ink is reduced to accelerate permeation of the ink to a printing material after the ink droplets are landed on the printing material, such as paper. Therefore, feathering or color bleeding can be reduced.

The surfactant is classified into a nonionic surfactant, an anionic surfactant, and amphoteric surfactant depending on a polarity of a hydrophilic group of the surfactant.

Moreover, the surfactant is classified into a fluorine-based surfactant, a silicone-based surfactant, and an acetylene-based surfactant depending on a structure of a hydrophobic group of the surfactant.

In the present disclosure, a fluorine-based surfactant is mainly used, but a silicone-based surfactant or an acetylene-based surfactant may be used in combination.

An amount of the surfactant is preferably 2.0% by mass or less, more preferably 0.05% by mass or greater but 2.0% by mass or less, and even more preferably 0.1% by mass or greater but 2.0% by mass or less relative to a total amount of the clear ink. When the amount of the surfactant is 2.0% by mass or less, significant reduction in glossiness can be achieved with a matte gloss printing mode.

As the surfactant, any of silicone-based surfactant, fluorosurfactants, amphoteric surfactants, nonionic surfactants, and anionic surfactants can be used.

The silicone-based surfactant has no specific limit and can be suitably selected to suit to a particular application. Of these, preferred are silicone-based surfactants which are not decomposed even in a high pH environment. Specific examples thereof include, but are not limited to, side-chain-modified polydimethylsiloxane, both end-modified polydimethylsiloxane, one-end-modified polydimethylsiloxane, and sidechain-both-end-modified polydimethylsiloxane. A silicone-based surfactant having a polyoxyethylene group or a polyoxyethylene polyoxypropylene group is particularly preferable because such an agent demonstrates good characteristics as an aqueous surfactant. It is possible to use a polyether-modified silicone-based surfactant as the silicone-based surfactant. A specific example thereof is a compound in which a polyalkylene oxide structure is introduced into the side chain of the Si site of dimethyl silooxane.

Specific examples of the fluoro surfactants include, but are not limited to, perfluoroalkyl sulfonic acid compounds, perfluoroalkyl carboxylic acid compounds, perfluoroalkyl phosphoric acid ester compounds, adducts of perfluoroalkyl ethylene oxide, and polyoxyalkylene ether polymer compounds having a perfluoroalkyl ether group in its side chain. These are particularly preferable because they do not foam easily. Specific examples of the perfluoroalkyl sulfonic acid compounds include, but are not limited to, perfluoroalkyl sulfonic acid and salts of perfluoroalkyl sulfonic acid. Specific examples of the perfluoroalkyl carboxylic acid compounds include, but are not limited to, perfluoroalkyl carboxylic acid and salts of perfluoroalkyl carboxylic acid. Specific examples of the polyoxyalkylene ether polymer compounds having a perfluoroalkyl ether group in its side chain include, but are not limited to, sulfuric acid ester salts of polyoxyalkylene ether polymer having a perfluoroalkyl ether group in its side chain and salts of polyoxyalkylene ether polymers having a perfluoroalkyl ether group in its side chain. Counter ions of salts in these fluorine-based surfactants are, for example, Li, Na, K, $NH_4$, $NH_3CH_2CH_2OH$, $NH_2(CH_2CH_2OH)_2$, and $NH(CH_2CH_2OH)_3$.

Specific examples of the amphoteric surfactants include, but are not limited to, lauryl aminopropionic acid salts, lauryl dimethyl betaine, stearyl dimethyl betaine, and lauryl dihydroxyethyl betaine.

Specific examples of the nonionic surfactants include, but are not limited to, polyoxyethylene alkyl phenyl ethers, polyoxyethylene alkyl esters, polyoxyethylene alkyl amines, polyoxyethylene alkyl amides, polyoxyethylene propylene block polymers, sorbitan aliphatic acid esters, polyoxyethylene sorbitan aliphatic acid esters, and adducts of acetylene alcohol with ethylene oxides, etc.

Specific examples of the anionic surfactants include, but are not limited to, polyoxyethylene alkyl ether acetates, dodecyl benzene sulfonates, laurates, and polyoxyethylene alkyl ether sulfates.

These can be used alone or in combination.

The silicone-based surfactants has no particular limit. Specific examples thereof include, but are not limited to, side-chain-modified polydimethyl siloxane, both end-modified polydimethylsiloxane, one-end-modified polydimethylsiloxane, and sidechain-both-end-modified polydimethylsiloxane. In particular, a polyether-modified silicone-based surfactant having a polyoxyethylene group or a polyoxyethylene polyoxypropylene group is particularly preferable because such a surfactant demonstrates good characteristics as an aqueous surfactant.

Any suitably synthesized surfactant and any product thereof available on the market is suitable. Products available on the market are obtained from Byc Chemie Japan Co., Ltd., Shin-Etsu Silicone Co., Ltd., Dow Corning Toray Co., Ltd., etc., NIHON EMULSION Co., Ltd., Kyoeisha Chemical Co., Ltd., etc.

The polyether-modified silicon-containing surfactant has no particular limit. For example, a compound in which the polyalkylene oxide structure represented by the following Chemical structure S-1 is introduced into the side chain of the Si site of dimethyl polysiloxane.

[Chem.5]

Chemical Structure (S-1)

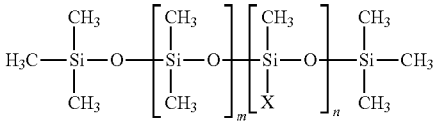

$X = —R(C_2H_4O)_a(C_3H_6O)_bR'$

In the Chemical structure S-1, "m", "n", "a", and "b" each, respectively represent integers, R represents an alkylene group, and R' represents an alkyl group.

Specific examples of polyether-modified silicone-based surfactants include, but are not limited to, KF-618, KF-642, and KF-643 (all manufactured by Shin-Etsu Chemical Co., Ltd.), EMALEX-SS-5602 and SS-1906EX (both manufactured by NIHON EMULSION Co., Ltd.), FZ-2105, FZ-2118, FZ-2154, FZ-2161, FZ-2162, FZ-2163, and FZ-2164 (all manufactured by Dow Corning Toray Co., Ltd.), BYK-33 and BYK-387 (both manufactured by BYK Japan KK.), and TSF4440, TSF4452, and TSF4453 (all manufactured by Momentive Performance Materials Inc.).

A fluorosurfactant in which the number of carbon atoms replaced with fluorine atoms is from 2 to 16 is preferable and, 4 to 16, more preferable.

Specific examples of the fluorosurfactants include, but are not limited to, perfluoroalkyl phosphoric acid ester compounds, adducts of perfluoroalkyl ethylene oxide, and polyoxyalkylene ether polymer compounds having a perfluoroalkyl ether group in its side chain. Of these, polyoxyalkylene ether polymer compounds having a perfluoroalkyl ether group in its side chain are preferable because they do not foam easily and the fluorosurfactant represented by the following Chemical formula F-1 or Chemical formula F-2 is more preferable.

[Chem.6]

$$CF_3CF_2(CF_2CF_2)_m—CH_2CH_2O(CH_2CH_2O)_nH \quad \text{Chemical Formula (F-1)}$$

In the Chemical formula f-1, "m" is preferably 0 or an integer of from 1 to 10 and "n" is preferably 0 or an integer of from 1 to 40.

$$C_nF_{2n+1}CH_2CH(OH)CH_2—O—(CH_2CH_2O)_a—Y \quad \text{Chemical Formula (F-2)}$$

In the Chemical formula F-2, Y represents H, where "n" is an integer of from 1 to 6, $H_2CH(OH)CH_2—C_nF_{2n+1}$, where n represents an integer of from 4 to 6, or $C_pH_{2p+1}$, where p represents an integer of from 1 to 19. "a" represents an integer of from 4 to 14.

Products available on the market may be used as the fluorosurfactant. Specific examples of the products available on the market include, but are not limited to, SURFLON S-111, SURFLON S-112, SURFLON S-121, SURFLON S-131, SURFLON S-132, SURFLON S-141, and SURFLON S-145 (all manufactured by ASAHI GLASS CO., LTD.); FLUORAD FC-93, FC-95, FC-98, FC-129, FC-135, FC-170C, FC-430, and FC-431 (all manufactured by SUMITOMO 3M); MEGAFACE F-470, F-1405, and F-474 (all manufactured by DIC CORPORATION); ZONYL (registered trademark) TBS, FSP, FSA, FSN-100, FSN, FSO-100, FSO, FS-300, UR, CAPSTONE (registered trademark) FS-30, FS-31, FS-3100, FS-34, FS-35 (all manufactured by The Chemours Company); FT-110, FT-250, FT-251, FT-4005, FT-150, and FT-400SW (all manufactured by NEOS COMPANY LIMITED); POLYFOX PF-136A, PF-156A, PF-151N, PF-154, PF-159 (manufactured by OMNOVA SOLUTIONS INC.), and UNIDYNE DSN-403N (manufactured by DAIKIN INDUSTRIES). Of these, FT-110, FT-250, FT-251, FT-4005, FT-150, and FT-400SW (all manufactured by The Chemours Company), PolyFox PF-151N (manufactured by OMNOVA SOLUTIONS INC.), and UNIDYNE DSN-403N (manufactured by DAIKIN INDUSTRIES) are particularly preferable in terms of good printing quality, coloring in particular, and improvement on permeation, wettability, and uniform dying property to paper.

The clear ink may include, as other ingredients, a defoaming agent, a preservative and fungicide, a corrosion inhibitor, and a pH regulator, according to the necessity.

As the defoaming agent, preservative and fungicide, corrosion inhibitor, and pH regulator of the clear ink, those similar to the defoaming agent, preservative and fungicide, corrosion inhibitor, and pH regulator of the washing liquid can be used.

The property of the clear ink is not particularly limited. For example, viscosity, surface tension, pH, etc. are preferably in the following ranges.

The viscosity of the clear ink at 25 degrees C. is preferably from 5 to 30 mPa·s and more preferably from 5 to 25 mPa·s to improve print density and text quality and obtain good dischargeability. The viscosity can be measured by, for example, a rotatory viscometer (RE-80L, manufactured by TOKI SANGYO CO., LTD.). The measuring conditions are as follows:

Standard cone rotor (1 degrees 34'×R24)

Sample liquid amount: 1.2 mL

Number of rotations: 50 rotations per minute (rpm)

25 degrees C.

Measuring time: three minutes

The surface tension of the clear ink is preferably 35 mN/m or less and more preferably 32 mN/m or less at 25 degrees C. in terms that the clear ink is suitably levelized on a printing material and the drying time of the clear ink is shortened.

The pH of the clear ink is preferably from 7 to 12 and more preferably from 8 to 11 in terms of prevention of corrosion of metal materials contacting the clear ink.

<Printing Material>

The printing material is not limited to materials used as recording media. For example, building materials (e.g., wall paper, floor materials, and tiles), cloth for apparel (e.g., T-shirts), textiles, and leather are appropriately applied as the printing material. Note that, ceramics, glass, or metals may be also used as the printing material by adjusting a structure of a path where a print medium is transported The print medium is not particularly limited. Plain paper, gloss paper, special paper, or cloth may be used as the recording material, but image formation can be also excellently performed using a non-permeable base.

The non-permeable base is a base having a surface of low water permeation and absorption. The non-permeable base includes a material where a number of yids are included inside the material but the voids are not exposed to the surfaces of the material. More quantitatively, the non-permeable base is a base having water absorption of 10 mL/$m^2$ or less determined from the starting of contact to 30 $msec^{1/2}$.

As the non-permeable base, for example, a plastic film, such as a vinyl chloride resin film, a polyethylene terephthalate (PET) film, an acrylic resin film, a polypropylene film, a polyethylene film, and polycarbonate film, is suitably used.

In the present disclosure, a printing material having high glossiness is preferably used with the matte gloss printing mode. Use of the material having high glossiness is preferable because a matte gloss effect obtainable by the clear ink can be easily enhanced.

On the other hand, a printing material having low glossiness is preferably used with the gloss printing mode. Use of the material having low glossiness is preferable because a gloss effect obtainable by the clear ink can be easily enhanced.

Accordingly, the following formula $G_{matte}>G_{gloss}$ is preferably satisfied and the following formula $G_{matte}-G_{gloss}\geq 100$ is more preferably satisfied where $G_{matte}$ is glossiness of the printing material used for the matte gloss printing mode, and $G_{gloss}$ is glossiness of the printing material used for the gloss printing mode.

<Method for Controlling Glossiness of Print Image>

A method for controlling glossiness of a print image of the present disclosure includes: ejecting an ink to a printing material using an ejection head having a nozzle to form a print layer; heating the printed printing material with a heating unit; and washing a nozzle-formed surface of the ejection head with a washing liquid. The ink is a clear ink including a resin. The method has a low gloss printing mode that is a printing mode for applying low gloss, and a high gloss printing mode that is a printing mode for applying high gloss. A temperature of a heating unit is controlled to be high when printing is performed with the low gloss printing mode. A temperature of the heating unit is controlled to be low when printing is performed with high gloss printing mode.

<Printed Matter>

The printed matter of the present disclosure include a printing material and a print layer on the printing material. The print layer is a clear ink layer including a resin. The printed matter includes a low gloss print image printed with a low gloss printing mode and a high gloss print image printed with a high gloss printing mode. A glossiness difference (Ga−Gb) between 60 degrees glossiness Ga of the high gloss print image and 60 degrees glossiness Gb of the printing material used with the high gloss printing mode is 20 or greater. A glossiness difference (Gc−Gd) between 60 degrees glossiness Gc of the low gloss print image and 60 degrees glossiness Gd of the printing material used with the low gloss printing mode is −20 or less.

An image is formed by the inkjet printing device and the inkjet printing method to form printed matter.

<Printing Device and Printing Method>

The printing device and the printing method will be described as a case where a black (K) ink, a cyan (C) ink, a magenta (M) ink, and a yellow (Y) ink are used, hereinafter. However, a clear ink may be used instead of or in addition to the black (K) ink, the cyan (C) ink, the magenta (M) ink, and the yellow (Y) ink.

The clear ink for use in the present disclosure can be suitably used for various printing devices according to an inkjet printing system, such as a printer, a facsimile, a photocopier, printer/fax/copier multifunction peripheral, and a 3D printer.

The inkjet printing device may be a serial type device where an inkjet head is moved, or a line-type device where an ejection head is not moved, unless otherwise stated.

Furthermore, in addition to the desktop type, the inkjet printing device includes a wide printing device, or a continuous printer capable of using continuous paper wound up in a roll form as print media.

In the present disclosure, the printing device and the printing method represent a device capable of discharging an ink, various processing fluids, etc. to a print medium and a method printing an image on the print medium using the device. The print medium means an article to which the ink or the various processing fluids can be attached at least temporarily.

The printing device may further optionally include a device relating to feeding, transferring, and ejecting the print medium and other devices referred to as a pre-processing device, a post-processing device, etc. in addition to the head portion to discharge the ink.

In addition, the printing device and the printing method are not limited to those producing merely meaningful visible images such as texts and figures with the ink. For example, the printing device and the printing method can produce patterns like geometric design and 3D images.

In addition, the printing device includes both a serial type device in which the liquid discharging head is caused to move and a line type device in which the liquid discharging head is not moved, unless otherwise specified.

Furthermore, in addition to the desktop type, this printing device includes a wide type capable of printing images on a large print medium such as AO, a continuous printer capable of using continuous paper wound up in a roll form as print media.

The printing device of the present disclosure is described using an example with reference to FIG. 1 and FIG. 2. FIG. 1 is a perspective view illustrating the image printing device. FIG. 2 is a perspective view illustrating the main tank. An image forming apparatus 400 as an example of the printing device is a serial type image forming apparatus. A mechanical unit 420 is disposed in an exterior 401 of the image forming apparatus 400. Each ink accommodating unit (ink container) 411 of each main tank 410 (410*k*, 410*c*, 410*m*, and 410*y*) for each color of black (K), cyan (C), magenta (M), and yellow (Y) is made of a packing member such as an aluminium laminate film. The ink container 411 is accommodated in a plastic housing unit 414. As a result, the main tank 410 is used as an ink cartridge of each color.

A cartridge holder 404 is disposed on the rear side of the opening when a cover 401*c* is opened. The cartridge holder 404 is detachably attached to the main tank 410. As a result, each ink discharging outlet 413 of the main tank 410 is communicated with a discharging head 434 for each color via a supplying tube 436 for each color so that the ink can be discharged from the discharging head 434 to a print medium.

This printing device may include not only a portion discharging ink but also a device referred to as a pre-processing device, a post-processing device, etc.

As an example of the pre-processing device and the post-processing device, as in the case of the ink such as black (K), cyan (C), magenta (M), and yellow (Y), a liquid container containing a pre-processing fluid or a post-processing fluid and a liquid discharging head are added to discharge the pre-processing fluid or the post-processing fluid in an inkjet printing method.

As another example of the pre-processing device and the post-processing device, it is suitable to dispose a pre-processing device and a post-processing device employing a blade coating method, a roll coating method, or a spray coating method other than the inkjet printing method.

How to use the ink is not limited to the ink printing method. Specific examples of such methods other than the inkjet printing method include, but are not limited to, blade coating methods, gravure coating methods, bar coating methods, roll coating methods, knife coating methods, dip coating methods, die coating methods, and spray coating methods.

The applications of the ink of the present disclosure are not particularly limited. For example, the ink can be used for printed matter, a print, a coating material, and foundation. The ink can be used to form two-dimensional texts and images and furthermore a three-dimensional solid object (3D modeling object) as a material for 3D modeling.

An apparatus for fabricating a three-dimensional object can be any known device with no particular limit. For example, the apparatus includes an ink container, a supplying device, a discharging device, a drier, etc. The three-dimensional solid object includes an object manufactured by re-applying ink. In addition, the three-dimensional solid object can be manufactured by processing a structure having a substrate such as a print medium printed with the ink as a modeled processed product. The modeled processed product is fabricated by, for example, heating drawing or punching a structure or printed matter having a sheet-like form, film-like form, etc. For example, the ink can be suitably used for the application of forming after decorating a surface, such as panels of meters or control units of cars, OA appliances, electric or electronic devices, cameras, etc.

Moreover, image forming, recording, printing, etc. in the present disclosure represent the same meaning.

A print medium, a medium, and a printing material represent the same meaning.

EXAMPLES

The present disclosure will be described more detail by way of Examples. However, the present disclosure should not be construed as being limited to these Examples.

Preparation Example 1

<Preparation of Polycarbonate-Based Polyurethane Resin Emulsion 1>

A reaction vessel equipped with a stirrer, a reflux condenser, and a thermometer was charged with 1,500 parts by mass of polycarbonate diol (a reaction product between 1,6-hexanediol and dimethyl carbonate (number average molecular weight (Mn): 1,200), 220 parts by mass of 2,2-dimethylolpropionic acid (may be referred to as "DMPA" hereinafter), and 1,347 parts by mass of N-methylpyrrolidone (may be referred to as "NMP" hereinafter) under a nitrogen flow, and the resultant mixture was heated at 60 degrees Celsius to dissolve DMPA.

Next, 1,445 parts by mass of 4,4'-dicyclohexylmethanediixocyanate and 2.6 parts by mass of dibutyl tin laurate (catalyst) were added, and the resultant mixture was heated at 90 degrees Celsius to perform an urethanation reaction for 5 hours, to thereby obtain a urethane prepolymer including an isocyanate terminal. The resultant reaction mixture was cooled to 80 degrees Celsius. To the reaction mixture, 149 parts by mass of trimethylamine was added and mixed. From the resultant mixture, 4,340 parts by mass of the mixture was taken out. The mixture was then added to a mixed solution including 5,400 parts by mass of water and 15 parts by mass of trimethylamine with strongly stirring.

Next, to the resultant, 1,500 parts by mass of ice was added, and 626 parts by mass of a 35% by mass 2-methyl-1,5-pentanediamine aqueous solution were added to perform a chain extension reaction. Then, the solvent was removed to obtain a solid content of 30% by mass, to thereby obtain Polycarbonate-Based Polyurethane Resin Emulsion 1. The obtained polycarbonate-based polyurethane resin emulsion was measured by a "film formation temperature tester" (available from Imoto Machinery Co., Ltd.). As a result, the minimum film formation temperature was 55 degrees Celsius.

Preparation Example 2

<Preparation of Acrylic Resin Emulsion 1>

A reaction vessel equipped with a stirrer, a reflux condenser, a dripping device, and a thermometer was charged with 900 parts of ion-exchanged water and 1 part by mass of sodium lauryl sulfate, and the resultant mixture was heated to 70 degrees Celsius with stirring while purging the reaction vessel with nitrogen. The internal temperature of the reaction vessel was maintained at 70 degrees Celsius, and 4 parts by mass of potassium persulfate was added as a polymerization initiator to the mixture and dissolved therein. An emulsion that was produced in advance by adding 450 parts by mass of ion-exchanged water, 3 parts by mass of sodium lauryl sulfate, 20 parts by mass of acrylamide, 365 parts by mass of styrene, 545 parts by mass of butyl acrylate, and 10 parts by mass of methacrylic acid together with stirring was dripped into the reaction solution in the reaction vessel for 4 hours. After completing the dripping, the reaction was maintained for 3 hours. After cooling the obtained aqueous emulsion to room temperature, ion-exchanged water and a sodium hydroxide aqueous solution were added to the aqueous emulsion to adjust pH thereof to 8, to thereby obtain Acrylic Resin Emulsion 1 (solid content: 30% by mass).

Production Example 1

—Production of Aqueous Clear Ink A—

A mixture was prepared by adding 25% by mass of Polyurethane Resin Emulsion 1 (solid content: 30% by mass) of Preparation Example 1, 19% by mass of 1,2-propanediol, 11% by mass of 1,3-propanediol, 3% by mass of 1,2-butanediol, 6% by mass of a surfactant, the product name of FS-300 (fluorosurfactant, available from E.I. du Pont de Nemours & Company, solid content: 40% by mass), and 36% by mass of ultra pure water together, and mixing and stirring the resultant mixture.

Next, the obtained mixture was filtered with a polypropylene filter having an average pore size of 0.2 micrometers (product name: Betafine polypropylene pleated filter PPG series, available from 3M), to thereby produce Aqueous Clear Ink A.

Production Examples 2 to 6

—Production of Water-Based Clear Inks B to E and Solvent-Based Clear Ink F—

Water-Based Clear Inks B to E and Solvent-Based Clear Ink F were each produced in the same manner as in Production Example 1, except that the ink composition was changed to the ink composition presented in Table 1.

Production Example 7

—Production of Magenta Ink—

<Preparation of Self-Dispersible Magenta Pigment Dispersion>

After premixing a mixture of the following composition, the resultant mixture was circulated and dispersed by means of a disk-type bead mill (available from SHINMARU ENTERPRISES CORPORATION, KDL-type, media: using zirconia beads each having a diameter of 0.3 mm) for 7 hours, to thereby obtain a self-dispersible magenta pigment dispersion (pigment solid content: 15% by mass).

Pigment Red 122 (product name: Toner Magenta EO02, available from Clamant Japan K.K.): 15 parts by mass Anionic surfactant (product name: Pionin A-51-B, available from TAKEMOTO OIL & FAT Co., Ltd.): 2 parts by mass Ion-exchanged water: 83 parts by mass <Production of Magenta Ink>

Polyurethane Resin Emulsion 1 (solid content: 30% by mass) of Preparation Example 1 in the amount of 25% by mass, 20% by mass of the self-dispersible magenta pigment dispersion (pigment solid content: 15% by mass), 20% by mass of 1,2-propanediol, 11% by mass of 1,3-propanediol, 3% by mass of 1,2-butanediol, 6% by mass of FS-300 (product name) (fluorosurfactant, available from E.I. du Pont de Nemours & Company, solid content: 40% by mass) serving as a surfactant, and 15% by mass of ultra pure water were added together, mixed, and stirred, to thereby prepare a mixture.

The obtained mixture was filtered through a polypropylene filter having the average pore diameter of 0.2 micrometers (product name: Betafine polypropylene pleated filter PPG series, available from 3M), to thereby produce a magenta ink.

Production Examples 1 to 25 of Washing Liquid

<Production of Washing Liquids 1 to 25>

Each of Washing Liquids 1 to 25 was produced by mixing ingredients according to the composition and amounts presented in Tables 2-1 to 2-3 below.

TABLE 1

| | | Production Clear Ex. 1 Water-Based Ink A | Production Ex. 2 Water-Based Clear Ink B | Production Ex. 3 Water-Based Clear Ink C | Production Ex. 4 Water-Based Clear Ink D | Production Ex. 5 Water-Based Clear Ink E | Production Ex. 6 Soicent-Based Clear Ink F |
|---|---|---|---|---|---|---|---|
| Resin | Polyurethane Resin Emulsion 1 (water dispersible, solid content: 30 mass %) | 25 | 30 | 30 | 40 | — | 25 |
| | Acryl Resin Emulsion 1 (water dispersible, solid content: 30 mass %) | — | — | — | — | 40 | — |
| Water | Ultra pure water | 36 | 32.6 | 33.5 | 26.5 | 26.5 | — |
| Surfactant | FS-300 (availale from DuPont) (solid content: 40 mass %) | 6 | 6 | 4.5 | 4.5 | 4.5 | 6 |
| Organic solvent | 1,2-propanediol | 19 | 17.4 | 18 | 1.3 | 15 | 19 |
| | 1,3-propanediol | 11 | 11 | 11 | 11 | 11 | 11 |
| | 1,2-butanediol | 3 | 3 | 3 | 3 | 3 | 3 |
| | 1,2-hexanediol | — | — | — | — | — | 16 |
| | diethylene glycol | — | — | — | — | — | 20 |
| Total (mass %) | | 100 | 100 | 100 | 100 | 100 | 100 |
| Amount of solid content of resin in clear ink | | 7.5 | 9 | 9 | 12 | 12 | 7.5 |

TABLE 2-1

| | Ingredients (mass %) | | Washing Liquid No. 1 | 2 | 3 | 4 | 5 | 6 | 7 | 8 | 9 | 10 |
|---|---|---|---|---|---|---|---|---|---|---|---|---|
| Solvent | Compound of General Formula(1) | $R^1$ = methyl group | 50 | — | 50 | 50 | 50 | 50 | 50 | 50 | 50 | 50 |
| | | $R^1$ = butyl group | — | 50 | — | — | — | — | — | — | — | — |
| | Glycol ether compound amount of which dissolved in 100 g of water of 25° C. is greater than 5 g | dipropylene glycol monomethyl ether | 8 | 8 | 30 | 20 | — | — | 1 | 10 | — | — |
| | | tripropylene glycol monomethyl ether | — | — | — | — | 8 | — | — | — | — | — |
| | | triethylene glycol monomethyl ether | — | — | — | — | — | 8 | — | — | — | — |
| | | diethylene glycol diethyl ether | — | — | — | — | — | — | — | — | 10 | — |
| | | diethylene glycol dibutyl ether | — | — | — | — | — | — | — | — | — | 10 |
| | Glycol ether compound amount of which dissolved in 100 g of water of 25° C. is 5 g or less | dipropylene glycol monomethyl ether-n-butyl ether | — | — | — | — | — | — | — | — | — | — |
| | | tripropylene glycol monomethyl ether-n-butyl ether | — | — | — | — | — | — | — | — | — | — |
| Surfactant | Silicone surfactant | WET-240 | 1 | 1 | 1 | 1 | 1 | 1 | 1 | — | 1 | 1 |
| | | BYK-349 | — | — | — | — | — | — | — | 1 | — | — |
| | Polyoxyalkylene surfactant | A-60 | — | — | — | — | — | — | — | — | — | — |
| | | LS-106 | — | — | — | — | — | — | — | — | — | — |
| | | LS-110 | — | — | — | — | — | — | — | — | — | — |
| Water | Ion-exchanged water | | balance | balance | balance | balance | balance | balance | balance | balance | balance | balance |
| | Total (mass %) | | 100 | 100 | 100 | 100 | 100 | 100 | 100 | 100 | 100 | 100 |

TABLE 2-2

| | Ingredients (mass %) | | Washing liquid No. 11 | 12 | 13 | 14 | 15 | 16 | 17 | 18 | 19 | 20 |
|---|---|---|---|---|---|---|---|---|---|---|---|---|
| Solvent | Compound of General Formula (1) | $R^1$ = methyl group | 50 | 50 | 50 | 50 | 20 | 40 | 50 | 40 | 59 | 60 |
| | | $R^1$ = butyl group | — | — | — | — | — | — | — | — | — | — |
| | Glycol ether compound amount of which dissolved in 100 g of water of 25° C. is greater than 5 g | dipropylene glycol monomethyl ether | — | — | 8 | — | — | — | — | — | — | — |
| | | tripropylene glycol monomethyl ether | — | — | — | — | — | — | — | — | — | — |
| | | triethylene glycol monomethyl ether | — | — | — | — | — | — | — | — | — | — |
| | | diethylene glycol diethyl ether | 10 | 10 | — | 10 | 10 | 10 | 10 | 10 | 10 | 10 |
| | | diethylene glycol dibutyl ether | — | — | — | — | — | — | — | — | — | — |
| | Glycol ether compound amount of which dissolved in 100 g of water of 25° C. is 5 g or less | dipropylene glycol monomethyl ether-n-butyl ether | 10 | 10 | 10 | — | 10 | 10 | 10 | 30 | 20 | 20 |
| | | tripropylene glycol monomethyl ether-n-butyl ether | — | — | — | 10 | — | — | — | — | — | — |

TABLE 2-2-continued

| Ingredients (mass %) | | | Washing liquid No. 11 | 12 | 13 | 14 | 15 | 16 | 17 | 18 | 19 | 20 |
|---|---|---|---|---|---|---|---|---|---|---|---|---|
| Surfootant | Silicone surfactant | WET-240 | 1 | 1 | 1 | 1 | — | — | — | 1 | 1 | 1 |
| | | BYK-349 | — | — | — | — | — | — | — | — | — | — |
| | Polyoxyalkylene surfactant | A-60 | — | — | — | — | 1 | — | — | — | — | — |
| | | LS-106 | — | — | — | — | — | 1 | — | — | — | — |
| | | LS-110 | — | — | — | — | — | — | 1 | — | — | — |
| Water | Ion-exchanged water | | balance | balance | balance | balance | balance | balance | balance | balance | balance | balance |
| | Total (mass %) | | 100 | 100 | 100 | 100 | 100 | 100 | 100 | 100 | 100 | 100 |

TABLE 2-3

| Ingredients (mass %) | | | Washing liquid No. 21 | 22 | 23 | 24 | 25 |
|---|---|---|---|---|---|---|---|
| Solvent | Compound of General Formula (1) | $R^1$ = methyl group | — | 50 | 50 | 50 | 50 |
| | | $R^1$ = butyl group | — | — | — | — | — |
| | Glycol ether compound amount of which dissolved in 100 g of water of 25° C. is greater than 5 g | dipropylene glycol monomethyl ether | 10 | — | 31 | 8 | 0.4 |
| | | tripropylene glycol monomethyl ether | — | — | — | — | — |
| | | triethylene glycol monomethyl ether | — | — | — | — | — |
| | | diethylene glycol diethyl ether | — | — | — | — | — |
| | | diethylene glycol dibutyl ether | — | — | — | — | — |
| | Glycol ether compound amount of which dissolved in 100 g of water of 25° C. is 5 g or less | dipropylene glycol monomethyl ether-n-butyl ether | — | — | — | — | — |
| | | tripropylene glycol monomethyl ether-n-butyl ether | — | — | — | — | — |
| Surfactant | Silicone surfactant | WET-240 | 1 | 1 | 1 | — | 1 |
| | | BYK-349 | — | — | — | — | — |
| | Polyoxyalkylene surfactant | A-60 | — | — | — | — | — |
| | | LS-106 | — | — | — | — | — |
| | | LS-110 | — | — | — | — | — |
| Water | Ion-exchanged water | | balance | balance | balance | balance | balance |
| | Total (mass %) | | 100 | 100 | 100 | 100 | 100 |

The product names and manufacturers' names of the ingredients in Tables 2-1 to 2-3 are as described below.

<Solvent>

—Compound Represented by General Formula (1)—

$R^1$=methyl group (3-methoxy-N,N-dimethylpropionamide); Equamide M100 (available from Idemitsu Kosan Co., Ltd.)

$R^1$=butyl group (3-butoxy-N,N-dimethylpropionamide); Equamide B100 (available from Idemitsu Kosan Co., Ltd.)

—Glycol Ether Compound Amount of which Dissolved in 100 g of Water of 25 Degrees Celsius is Greater than 5 g—

Dipropylene glycol methyl ether (available from Tokyo Chemical Industry Co., Ltd.): the amount thereof dissolved in 100 g of water of 25 degrees Celsius is greater than 5 g and is infinite.

Tripropylene glycol monomethyl ether (available from Tokyo Chemical Industry Co., Ltd.): the amount thereof dissolved in 100 g of water of 25 degrees Celsius is greater than 5 g and is infinite.

Triethylene glycol monomethyl ether (available from Tokyo Chemical Industry Co., Ltd.): the amount thereof dissolved in 100 g of water of 25 degrees Celsius is greater than 5 g and is infinite.

Diethylene glycol diethyl ether (available from Tokyo Chemical Industry Co., Ltd.): the amount thereof dissolved in 100 g of water of 25 degrees Celsius is greater than 5 g and is infinite.

Diethylene glycol dibutyl ether (available from Tokyo Chemical Industry Co., Ltd.): the amount thereof dissolved in 100 g of water of 25 degrees Celsius is greater than 5 g and is infinite.

As an amount of the glycol ether compound dissolved in 100 g of water of 25 degrees Celsius, an amount of the solvent added drop by drop to water until the mixture is mixed and clouded is determined as a maximum dissolution amount.

—Glycol Ether Compound Amount of which Dissolved in 100 g of Water of 25 Degrees Celsius is 5 g or Less—

Dipropylene glycol monomethyl ether-n-butyl ether (available from Dow): the amount thereof dissolved in 100 g of water of 25 degrees Celsius is 5 g. Tripropylene glycol monomethyl ether-n-butyl ether (available from Dow): the amount thereof dissolved in 100 g of water of 25 degrees Celsius is 3 g. As an amount of the glycol ether compound dissolved in 100 g of water of 25 degrees Celsius, an amount of the solvent added drop by drop to water until the mixture is mixed and clouded is determined as a maximum dissolution amount.

<Surfactant>

—Silicone Surfactant—

Product name: WET-240, available from Nissin Chemical Co., Ltd.

Product name: BYK-349, available from BYK Japan KK

—Polyoxyalkylene Surfactant—

Product name: EMULGEN A-60 (polyoxyethylene distyrenated phenyl ether) (higher alcohol ether nonionic surfactant), available from Kao Corporation Product name: EMULGEN LS-106 (polyoxyethylene polyoxypropylene alkyl ether) (higher alcohol ether nonionic surfactant), available from Kao Corporation Product name: EMULGEN LS-110 (polyoxyethylene polyoxypropylene alkyl ether) (higher alcohol ether nonionic surfactant), available from Kao Corporation Example 1

<Inkjet Printing>

An ink cartridge of a modified device of an inkjet printer GXe5500 (available from Ricoh Company Limited) was loaded with Aqueous Clear Ink A of Production Example 1, and the ink cartridge loaded with the ink was mounted in the modified device of the inkjet printer GXe5500 to perform inkjet printing.

A heater (temperature adjusting controller, model MTCD, available from MISUMI Corporation) was disposed in the modified device of the inkjet printer GXe5500 in a manner that a print medium could be heated from a back surface thereof before, during, and after printing. As a result, printing could be performed on a printing medium heated before and during printing by the heater, and the printed matter could be heated and dried by the heater after printing.

Printing was performed with changing a type of a print medium for use, heating conditions, and a printing image according to the gloss printing mode and the matte gloss printing mode.

—Print Medium—

In the gloss printing mode, synthetic paper VJFN160 (available from YUPO CORPORATION, white polypropylene film, glossiness (60 degrees gloss value): 16) was used as Print Medium 1.

In the matte printing mode, a window film GIY0305 (available from LINTEC SIGN SYSTEM, INC., transparent polyethylene terephthalate (PET) film, glossiness (60 degrees gloss value): 159) was used as Print Medium 2.

—Heating Conditions—

As heating conditions, heating temperatures of each heater disposed before, during, and after printing with the gloss printing mode were set to 60 degrees Celsius, 60 degrees Celsius, and 70 degrees Celsius, respectively. Heating temperatures of each heater disposed before, during, and after printing with the matte gloss printing mode were set to 65 degrees Celsius, 65 degrees Celsius, and 70 degrees Celsius, respectively. The temperature (=$T_{gloss}$) of the heating unit when printing was performed with the gloss printing mode was 60 degrees Celsius, and the temperature (=$T_{matte}$) of the heating unit when printing was performed with the matte gloss printing mode was 65 degrees Celsius.

The temperature (=$T_{gloss}$) of the heating unit when printing was performed with the gloss printing mode was identical to the set temperature of the heater during printing (the upper column of Table 3-3).

The temperature (=$T_{matte}$) of the heating unit when printing was performed with the matte gloss printing mode was identical to the set temperature of the heater during printing (the bottom column of Table 3-3).

The image printed with the gloss printing mode was a solid image having image resolution of 600 dpi×600 dpi and a printing rate of 100%.

The image printed with the matte gloss printing mode was a half-tone image having image resolution of 600 dpi×600 dpi and a printing rate of 40%.

—Printing Rate—

Note that, the printing rate means as follows.

Printing rate (%)=the number of printed dots of clear ink/(vertical resolution×horizontal resolution)×100

(in the formula above, "the number of printed dots of clear ink" is the number of dots formed per unit area by actually printing Water-Based Clear Ink A, "vertical resolution" and "horizontal resolution" are each resolution per unit area, and in the case where Water-Based Clear Ink A is printed to overlap to form dots on the same positions, "the number of printed dots of clear ink" represents the total number of dots formed per unit area by actually printing Water-Based Clear Ink A.)

In both the matte gloss printing mode, and the gloss printing mode, printing was performed in a manner that Water-Based Clear Ink A was overlapped once to superimpose dots in the same positions.

Next, glossiness of the obtained printed matter was measured in the following manner. The results are presented in Table 3-3.

<Evaluation of Glossiness>

A 60 degrees gloss value of the clear ink printed area on which Water-Based Clear Ink A had been printed and a 60 degrees gloss value of the cleat ink unprinted area (print medium) on which Aqueous Clear Ink A had not been printed were measured by means of a gloss meter (Micro-tri-gloss, available from BYK Japan KK). The results were evaluated based on the following criteria. Note that, the 60 degrees gloss value was determined as glossiness.

(Evaluation Criteria)

Good: The glossiness difference (Ga−Gb) with 60 degrees glossiness Gb was 20 or greater, or the glossiness difference (Gc−Gd) with 60 degrees glossiness Gd was −20 or less.

Poor: The glossiness difference (Ga−Gb) with 60 degrees glossiness Gb was less than 20, or the glossiness difference (Gc−Gd) with 60 degrees glossiness Gd was greater than −20.

<Ejection Reliability Evaluation>

Printing was performed by continuously ejecting Water-Based Clear Ink A for 45 minutes using MH5440 (available from Ricoh Company Limited) as an inkjet head. Thirty minutes after the termination of the ejection, the nozzle surface of the inkjet head was wiped with a non-woven cloth (clean wiper ANTICON GOLD, polyester long fibers, available from HARADA CORPORATION) soaked with 50 microliters of Washing Liquid 15 using the washing unit of the inkjet printing device illustrated in FIG. 6. Thereafter, Clear Ink A was ejected again, and ejection reliability was evaluated based on the following evaluation criteria. The results are presented in Table 3-3.

(Evaluation Criteria)

Excellent: No ejection disturbance or no misfiring was observed.

Good: Ejection disturbance or misfiring was observed from 5 or less nozzles, but recovers soon.

Fair: Ejection disturbance or misfiring was observed from greater than 5 nozzles but 10 nozzles or less.

Poor: Ejection disturbance or misfiring was observed from greater than 10 nozzles.

<Detergence Evaluation>

Printing was performed by continuously ejecting Water-Based Clear Ink A for 45 minutes using MH5440 (available from Ricoh Company Limited) as an inkjet head. Twelve hours after the termination of the ejection, the nozzle surface of the inkjet head was wiped with a non-woven cloth (clean wiper ANTICON GOLD, polyester long fibers, available from HARADA CORPORATION) soaked with 50 microliters of Washing Liquid 15 using the washing unit of the inkjet printing device illustrated in FIG. 6. Thereafter, detergence was evaluated based on the following evaluation criteria. The results are presented in Table 3-3.

(Evaluation Criteria)

Excellent: No ink smear left after wiping was observed.

Good: There was less than 10% of the ink smear left after wiping, but no ink smear was left near the nozzles.

Fair: There was 10% or greater but less than 20% of the ink smear left after wiping, but the ink smear was left near the nozzles.

Poor: There was 20% or greater of the ink smear left after wiping.

Examples 2 to 7 and Examples 9 to 33, and Comparative Examples 1 to 5

Printed matter was obtained in the same manner as in Example 1, except that at least any of "ink type," "printing mode," "recording medium," "printed image," "printing part of clear ink," "printing rate," "the number of overlap coating of clear ink," "washing liquid," and "heater set temperature" was changed as presented in Tables 3-1, 3-2, 3-3, 4-1, 4-2, and 4-3. The obtained printed matter was evaluated in the same manner as in Example 1. The results are presented in Tables 3-3 and 4-3.

Example 8

Inkjet printing was performed in the same manner as in Example 1, except that a print medium on which the magenta ink of Production Example 7 had been printed was used. Specifically, Clear Ink E was printed on a coating film formed by printing the magenta ink of Production Example 7. As the magenta ink printed on the print medium, the magenta ink of Production Example 7 was used. A printing device identical to the printing device used for Clear Ink E was used for printing of the magenta ink. In order to form a coating film of the magenta ink using the gloss printing mode, only the magenta ink was printed on a print medium by setting the heating temperatures of the heaters before, during, and after printing to 50 degrees Celsius, 50 degrees Celsius, and 70 degrees Celsius, respectively. In order to form a coating film of the magenta ink using the matte gloss printing mode, only the magenta ink was printed on a print medium by setting the heating temperatures of the heaters to 70 degrees Celsius, 70 degrees Celsius, and 70 degrees Celsius, respectively. As each of the printed images of the magenta ink, a solid image having image resolution of 600 dpi×600 dpi and a printing rate of 100% was printed.

The obtained print medium on which the coating film of the magenta ink had been printed was again subjected to printing of Clear Ink E by means of the printing device.

Glossiness of the obtained printed matter was evaluated in the same manner as in Example 1. The results are presented in Table 3-3.

TABLE 3-1

| | Ink | Printing mode | Recording medium | Printed image |
|---|---|---|---|---|
| Ex. 1 | Clear Ink A | gloss | VJFN160 | whole solid image |
| | | matte gloss | GIY0305 | half-tone image |
| Ex. 2 | Clear Ink A | gloss | VJFN160 | whole solid image |
| | | matte gloss | GIY0305 | half-tone image |
| Ex. 3 | Clear Ink A | gloss | VJFN160 | whole solid image |
| | | matte gloss | GIY0305 | half-tone image |
| Ex. 4 | Clear Ink B | gloss | VJFN160 | whole solid image |
| | | matte gloss | GIY0305 | half-tone image |
| Ex. 5 | Clear Ink C | gloss | VJFN160 | whole solid image |
| | | matte gloss | GIY0305 | half-tone image |
| Ex. 6 | Clear Ink D | gloss | VJFN160 | whole solid image |
| | | matte gloss | GIY0305 | half-tone image |
| Ex. 7 | Clear Ink E | gloss | VJFN160 | whole solid image |
| | | matte gloss | GIY0305 | half-tone image |
| Ex. 8 | Clear Ink F | gloss | VJFN160 | whole solid image |
| | | matte gloss | GIY0305 | half-tone image |

TABLE 3-1-continued

| | Ink | Printing mode | Recording medium | Printed image |
|---|---|---|---|---|
| Ex. 9 | Clear Ink E + Magenta Ink | gloss | VJFN160 | whole solid mage |
| | | matte gloss | GIY0305 | half-tone image |
| Ex. 10 | Clear Ink A | gloss | VJFN160 | whole solid image |
| | | matte gloss | GIY0305 | half-tone image |
| Ex. 11 | Clear Ink A | gloss | VJFN160 | whole solid image |
| | | matte gloss | GIY0305 | half-tone image |
| Ex. 12 | Clear Ink A | gloss | VJFN160 | whole solid image |
| | | matte gloss | GIY0305 | half-tone image |
| Ex. 13 | Clear Ink A | gloss | VJFN160 | whole solid image |
| | | matte gloss | GIY0305 | half-tone image |
| Ex. 14 | Clear Ink A | gloss | VJFN160 | whole solid image |
| | | matte gloss | GIY0305 | half-tone image |
| Ex. 15 | Clear Ink A | gloss | VJFN160 | whole solid image |
| | | matte gloss | GIY0305 | half-tone image |
| Ex. 16 | Clear Ink A | gloss | VJFN160 | whole solid image |
| | | matte gloss | GIY0305 | half-tone image |
| Ex. 17 | Clear Ink A | gloss | VJFN160 | whole solid image |
| | | matte gloss | GIY0305 | half-tone image |
| Ex. 18 | Clear Ink A | gloss | VJFN160 | whole solid image |
| | | matte gloss | GIY0305 | half-tone image |
| Ex. 19 | Clear Ink A | gloss | VJFN160 | whole solid image |
| | | matte gloss | GIY0305 | half-tone image |
| Ex. 20 | Clear Ink A | gloss | VJFN160 | whole solid image |
| | | matte gloss | GIY0305 | half-tone image |

TABLE 3-2

| | Printing area | | | Time of overlap printing | Washing liquid | |
|---|---|---|---|---|---|---|
| | of clear ink | Printing rate | | of clear ink | presence | type |
| Ex. 1 | recording medium | $D_{gloss}$ | 100% | once | present | 15 |
| | | $D_{matte}$ | 40% | | | |
| Ex. 2 | recording medium | $D_{gloss}$ | 80% | once | present | 15 |
| | | $D_{matte}$ | 70% | | | |

TABLE 3-2-continued

| | Printing area | | | Time of overlap printing | Washing liquid | |
|---|---|---|---|---|---|---|
| | of clear ink | Printing rate | | of clear ink | presence | type |
| Ex. 3 | recording medium | $D_{gloss}$ | 100% | once | present | 15 |
| | | $D_{matte}$ | 40% | | | |
| Ex. 4 | recording medium | $D_{gloss}$ | 100% | once | present | 15 |
| | | $D_{matte}$ | 40% | | | |
| Ex. 5 | recording medium | $D_{gloss}$ | 100% | once | present | 15 |
| | | $D_{matte}$ | 40% | | | |
| Ex. 6 | recording medium | $D_{gloss}$ | 100% | once | present | 15 |
| | | $D_{matte}$ | 40% | | | |
| Ex. 7 | recording medium | $D_{gloss}$ | 100% | once | present | 15 |
| | | $D_{matte}$ | 40% | | | |
| Ex. 8 | magenta ink coating film | $D_{gloss}$ | 100% | once | present | 15 |
| | | $D_{matte}$ | 40% | | | |
| Ex. 9 | magenta ink coating film | $D_{gloss}$ | 100% | once | present | 15 |
| | | $D_{matte}$ | 40% | | | |
| Ex. 10 | recording medium | $D_{gloss}$ | 80% | once | present | 1 |
| | | $D_{matte}$ | 70% | | | |
| Ex. 11 | recording medium | $D_{gloss}$ | 80% | once | present | 2 |
| | | $D_{matte}$ | 70% | | | |
| Ex. 12 | recording medium | $D_{gloss}$ | 80% | once | present | 3 |
| | | $D_{matte}$ | 70% | | | |
| Ex. 13 | recording medium | $D_{gloss}$ | 80% | once | present | 4 |
| | | $D_{matte}$ | 70% | | | |
| Ex. 14 | recording medium | $D_{gloss}$ | 80% | once | present | 5 |
| | | $D_{matte}$ | 70% | | | |
| Ex. 15 | recording medium | $D_{gloss}$ | 80% | once | present | 6 |
| | | $D_{matte}$ | 70% | | | |
| Ex. 16 | recording medium | $D_{gloss}$ | 80% | once | present | 7 |
| | | $D_{matte}$ | 70% | | | |
| Ex. 17 | recording medium | $D_{gloss}$ | 80% | once | present | 8 |
| | | $D_{matte}$ | 70% | | | |
| Ex. 18 | recording medium | $D_{gloss}$ | 80% | once | present | 9 |
| | | $D_{matte}$ | 70% | | | |
| Ex. 19 | recording medium | $D_{gloss}$ | 80% | once | present | 10 |
| | | $D_{matte}$ | 70% | | | |
| Ex. 20 | recording medium | $D_{gloss}$ | 80% | once | present | 11 |
| | | $D_{matte}$ | 70% | | | |

TABLE 3-3

| | Heater set temperature | | | Glossiness evaluation | | Ejection | |
|---|---|---|---|---|---|---|---|
| | Before printing | During printing | After printing | Glossiness difference | Judgement | reliability Evaluation | Detergence Evaluation |
| Ex. 1 | 60° C. | 60° C. | 70° C. | 41 | Good | Excellent | Excellent |
| | 65° C. | 65° C. | 70° C. | −49 | Good | Excellent | Excellent |
| Ex. 2 | 60° C. | 60° C. | 70° C. | 24 | Good | Excellent | Excellent |
| | 65° C. | 65° C. | 70° C. | −39 | Good | Excellent | Excellent |
| Ex. 3 | 50° C. | 50° C. | 70° C. | 49 | Good | Excellent | Excellent |
| | 70° C. | 70° C. | 70° C. | −57 | Good | Excellent | Excellent |
| Ex. 4 | 50° C. | 50° C. | 70° C. | 52 | Good | Excellent | Excellent |
| | 70° C. | 70° C. | 70° C. | −64 | Good | Excellent | Excellent |
| Ex. 5 | 50° C. | 50° C. | 70° C. | 50 | Good | Excellent | Excellent |
| | 70° C. | 70° C. | 70° C. | −75 | Good | Excellent | Excellent |
| Ex. 6 | 50° C. | 50° C. | 70° C. | 54 | Good | Excellent | Excellent |
| | 70° C. | 70° C. | 70° C. | −82 | Good | Excellent | Excellent |
| Ex. 7 | 50° C. | 50° C. | 70° C. | 55 | Good | Excellent | Excellent |
| | 70° C. | 70° C. | 70° C. | −77 | Good | Excellent | Excellent |
| Ex. 8 | 50° C. | 50° C. | 70° C. | 52 | Good | Excellent | Excellent |
| | 70° C. | 70° C. | 70° C. | −39 | Good | Excellent | Excellent |
| Ex. 9 | 50° C. | 50° C. | 70° C. | 55 | Good | Excellent | Excellent |
| | 70° C. | 70° C. | 70° C. | −64 | Good | Excellent | Excellent |
| Ex. 10 | 60° C. | 60° C. | 70° C. | 24 | Good | Good | Good |
| | 65° C. | 65° C. | 70° C. | −39 | Good | Good | Good |
| Ex. 11 | 60° C. | 60° C. | 70° C. | 24 | Good | Good | Good |
| | 65° C. | 65° C. | 70° C. | −39 | Good | Good | Good |
| Ex. 12 | 60° C. | 60° C. | 70° C. | 24 | Good | Good | Good |
| | 65° C. | 65° C. | 70° C. | −39 | Good | Good | Good |
| Ex. 13 | 60° C. | 60° C. | 70° C. | 24 | Good | Good | Good |
| | 65° C. | 65° C. | 70° C. | −39 | Good | Good | Good |
| Ex. 14 | 60° C. | 60° C. | 70° C. | 24 | Good | Good | Good |
| | 65° C. | 65° C. | 70° C. | −39 | Good | Good | Good |

TABLE 3-3-continued

| | Heater set temperature | | | Glossiness evaluation | | Ejection | |
|---|---|---|---|---|---|---|---|
| | Before printing | During printing | After printing | Glossiness difference | Judgement | reliability Evaluation | Detergence Evaluation |
| Ex. 15 | 60° C. | 60° C. | 70° C. | 24 | Good | Good | Good |
| | 65° C. | 65° C. | 70° C. | −39 | Good | Good | Good |
| Ex. 16 | 60° C. | 60° C. | 70° C. | 24 | Good | Good | Good |
| | 65° C. | 65° C. | 70° C. | −39 | Good | Good | Good |
| Ex. 17 | 60° C. | 60° C. | 70° C. | 24 | Good | Good | Good |
| | 65° C. | 65° C. | 70° C. | −39 | Good | Good | Good |
| Ex. 18 | 60° C. | 60° C. | 70° C. | 24 | Good | Good | Good |
| | 65° C. | 65° C. | 70° C. | −39 | Good | Good | Good |
| Ex. 19 | 60° C. | 60° C. | 70° C. | 24 | Good | Good | Good |
| | 65° C. | 65° C. | 70° C. | −39 | Good | Good | Good |
| Ex. 20 | 60° C. | 60° C. | 70° C. | 24 | Good | Fair | Good |
| | 65° C. | 65° C. | 70° C. | −39 | Good | Fair | Good |

*In Table 3-3, the temperature (=$T_{gloss}$) of the heating unit when printing was performed with the gloss printing mode was identical to the set temperature of the heater during printing (the upper column of Table 3-3); the temperature (=$T_{matte}$) of the heating unit when printing was performed with the matte gloss printing mode was identical to the set temperature of the heater during printing (the bottom column Table 3-3).

TABLE 4-1

| | Ink | Printing mode | Recording medium | Printed image |
|---|---|---|---|---|
| Ex. 21 | Clear Ink A | gloss | VJFN160 | whole solid image |
| | | matte gloss | GIY0305 | half-tone image |
| Ex. 22 | Clear Ink A | gloss | VJFN160 | whole solid image |
| | | matte gloss | GIY0305 | half-tone image |
| Ex. 23 | Clear Ink A | gloss | VJFN160 | whole solid image |
| | | matte gloss | GIY0305 | half-tone image |
| Ex. 24 | Clear Ink A | gloss | VJFN160 | whole solid image |
| | | matte gloss | GIY0305 | half-tone image |
| Ex. 25 | Clear Ink A | gloss | VJFN160 | whole solid image |
| | | matte gloss | GIY0305 | half-tone image |
| Ex. 26 | Clear Ink A | gloss | VJFN160 | whole solid image |
| | | matte gloss | GIY0305 | half-tone image |
| Ex. 27 | Clear Ink A | gloss | VJFN160 | whole solid image |
| | | matte gloss | GIY0305 | half-tone image |
| Ex. 28 | Clear Ink A | gloss | VJFN160 | whole solid image |
| | | matte gloss | GIY0305 | half-tone image |
| Ex. 29 | Clear Ink A | gloss | VJFN160 | whole solid image |
| | | matte gloss | GIY0305 | half-tone image |
| Ex. 30 | Clear Ink A | gloss | VJFN160 | whole solid image |
| | | matte gloss | GIY0305 | half-tone image |
| Ex. 31 | Clear Ink A | gloss | VJFN160 | whole solid image |
| | | matte gloss | GIY0305 | half-tone image |
| Ex. 32 | Clear Ink A | gloss | VJFN160 | whole solid image |
| | | matte gloss | GIY0305 | half-tone image |
| Ex. 33 | Clear Ink A | gloss | VJFN160 | whole solid image |
| | | matte gloss | GIY0305 | half-tone image |
| Comp. Ex. 1 | Clear Ink A | gloss | VJFN160 | half-tone image |
| | | matte gloss | GIY0305 | half-tone image |
| Comp. Ex. 2 | Clear Ink A | gloss | VJFN160 | whole solid image |
| | | matte gloss | GIY0305 | half-tone image |
| Comp. Ex. 3 | Clear Ink A | gloss | VJFN160 | whole solid image |
| | | matte gloss | GIY0305 | whole solid image |
| Comp. Ex. 4 | Clear Ink A | gloss | VJFN160 | whole solid image |
| | | matte gloss | GIY0305 | half-tone image |
| Comp. Ex. 5 | Clear Ink A | gloss | VJFN160 | whole solid image |
| | | matte gloss | GIY0305 | half-tone image |

TABLE 4-2

| | Printing area | | | Number of overlap printing | Washing liquid | |
|---|---|---|---|---|---|---|
| | of clear ink | Printing rate | | of clear ink | presence | type |
| Ex. 21 | recording medium | $D_{gloss}$ | 80% | once | present | 12 |
| | | $D_{matte}$ | 70% | | | |
| Ex. 22 | recording medium | $D_{gloss}$ | 80% | once | present | 13 |
| | | $D_{matte}$ | 70% | | | |

TABLE 4-2-continued

| | Printing area | | | Number of overlap printing | Washing liquid | |
|---|---|---|---|---|---|---|
| | of clear ink | Printing rate | | of clear ink | presence | type |
| Ex. 23 | recording medium | $D_{gloss}$ | 80% | once | present | 14 |
| | | $D_{matte}$ | 70% | | | |
| Ex. 24 | recording medium | $D_{gloss}$ | 80% | once | present | 16 |
| | | $D_{matte}$ | 70% | | | |
| Ex. 25 | recording medium | $D_{gloss}$ | 80% | once | present | 17 |
| | | $D_{matte}$ | 70% | | | |
| Ex. 26 | recording medium | $D_{gloss}$ | 80% | once | present | 18 |
| | | $D_{matte}$ | 70% | | | |
| Ex. 27 | recording medium | $D_{gloss}$ | 80% | once | present | 19 |
| | | $D_{matte}$ | 70% | | | |
| Ex. 28 | recording medium | $D_{gloss}$ | 80% | once | present | 20 |
| | | $D_{matte}$ | 70% | | | |
| Ex. 29 | recording medium | $D_{gloss}$ | 80% | once | present | 21 |
| | | $D_{matte}$ | 70% | | | |
| Ex. 30 | recording medium | $D_{gloss}$ | 80% | once | present | 22 |
| | | $D_{matte}$ | 70% | | | |
| Ex. 31 | recording medium | $D_{gloss}$ | 80% | once | present | 23 |
| | | $D_{matte}$ | 70% | | | |
| Ex. 32 | recording medium | $D_{gloss}$ | 80% | once | present | 24 |
| | | $D_{matte}$ | 70% | | | |
| Ex. 33 | recording medium | $D_{gloss}$ | 80% | once | present | 25 |
| | | $D_{matte}$ | 70% | | | |
| Comp. Ex. 1 | recording medium | $D_{gloss}$ | 80% | once | present | 15 |
| | | $D_{matte}$ | 70% | | | |
| Comp. Ex. 2 | recording medium | $D_{gloss}$ | 100% | once | present | 15 |
| | | $D_{matte}$ | 40% | | | |
| Comp. Ex. 3 | unprinted | $D_{gloss}$ | 100% | — | present | 15 |
| | | $D_{matte}$ | 100% | | | |
| Comp. Ex. 4 | recording medium | $D_{gloss}$ | 100% | once | present | 15 |
| | | $D_{matte}$ | 40% | | | |
| Comp. Ex. 5 | recording medium | $D_{gloss}$ | 80% | once | absent | — |
| | | $D_{matte}$ | 70% | | | |

TABLE 4-3

| | Heater set temperature | | | Glossiness evaluation | | Ejection | |
|---|---|---|---|---|---|---|---|
| | Before printing | During printing | After printing | Glossiness difference | Judgement | reliability Evaluation | Detergence Evaluation |
| Ex. 21 | 60° C. | 60° C. | 70° C. | 24 | Good | Fair | Good |
| | 65° C. | 65° C. | 70° C. | −39 | Good | Fair | Good |
| Ex. 22 | 60° C. | 60° C. | 70° C. | 24 | Good | Good | Good |
| | 65° C. | 65° C. | 70° C. | −39 | Good | Good | Good |
| Ex. 23 | 60° C. | 60° C. | 70° C. | 24 | Good | Fair | Good |
| | 65° C. | 65° C. | 70° C. | −39 | Good | Fair | Good |
| Ex. 24 | 60° C. | 60.° C. | 70° C. | 24 | Good | Fair | Excellent |
| | 65° C. | 65° C. | 70° C. | −39 | Good | Fair | Excellent |
| Ex. 25 | 60° C. | 60° C. | 70° C. | 24 | Good | Fair | Excellent |
| | 65° C. | 65° C. | 70° C. | −39 | Good | Fair | Excellent |
| Ex. 26 | 60° C. | 60° C. | 70° C. | 24 | Good | Fair | Good |
| | 65° C. | 65° C. | 70° C. | −39 | Good | Fair | Good |
| Ex. 27 | 60° C. | 60° C. | 70° C. | 24 | Good | Fair | Good |
| | 65° C. | 65° C. | 70° C. | −39 | Good | Fair | Good |
| Ex. 28 | 60° C. | 60° C. | 70° C. | 24 | Good | Good | Good |
| | 65° C. | 65° C. | 70° C. | −39 | Good | Good | Good |
| Ex. 29 | 60° C. | 60° C. | 70° C. | 24 | Good | Fair | Fair |
| | 65° C. | 65° C | 70° C. | −39 | Good | Fair | Fair |
| Ex. 30 | 60° C. | 60° C. | 70° C. | 24 | Good | Fair | Fair |
| | 65° C. | 65° C. | 70° C. | −39 | Good | Fair | Fair |
| Ex. 31 | 60° C. | 60° C. | 70° C. | 24 | Good | Good | Good |
| | 65° C. | 65° C. | 70° C. | −39 | Good | Good | Good |
| Ex. 32 | 60° C. | 60° C. | 70° C. | 24 | Good | Fair | Fair |
| | 65° C. | 65° C. | 70° C. | −39 | Good | Fair | Fair |
| Ex. 33 | 60° C. | 60° C. | 70° C. | 24 | Good | Fair | Fair |
| | 65° C. | 65° C. | 70° C. | −39 | Good | Fair | Fair |
| Comp. | 65° C. | 65° C. | 70° C. | 14 | Poor | Excellent | Excellent |
| Ex. 1 | 65° C. | 65° C. | 70° C. | −19 | Poor | Excellent | Excellent |
| Comp. | 65° C. | 65° C. | 70° C. | 19 | Poor | Excellent: | Excellent: |
| Ex. 2 | 65° C. | 65° C. | 70° C. | −21 | Poor | Excellent | Excellent |
| Comp. | 50° C. | 50° C. | 70° C. | NA | Poor | Excellent: | Excellent: |
| Ex. 3 | 70° C. | 70° C. | 70° C. | NA | Poor | Excellent | Excellent |
| Comp. | 65° C. | 65° C. | 70° C. | 19 | Poor | Excellent | Excellent |
| Ex. 4 | 60° C. | 60° C. | 70° C. | −16 | Poor | Ex.cellent | Ex.cellent |
| Comp. | 60° C. | 60° C. | 70° C. | 24 | Good | Poor | Poor |
| Ex. 5 | 65° C. | 65° C. | 70° C. | −39 | Good | Poor | Poor |

*In Table 4-3, the glossiness difference "NA" of Comparative Example 3 means that the glossiness cannot be measured.

*In Table 4-3, the temperature (=$T_{gloss}$) of the heating unit when printing was performed with the gloss printing mode was identical to the set temperature of the heater during printing (the upper column of Table 4-3);

the temperature (=$T_{matte}$) of the heating unit when printing was performed with the matte gloss printing mode was identical to the set temperature of the heater during printing (the bottom column of Table 4-3).

For example, embodiments of the present disclosure are as follows.

<1> An inkjet printing device including:

an ink storage unit configured to store an ink;

an ejection head having a nozzle configured to eject the ink to a printing material; a heating unit configured to heat the printing material; and a washing unit configured to wash a nozzle-formed surface of the ejection head with a washing liquid, wherein the ink is a clear ink including a resin, the inkjet printing device has a low gloss printing mode that is a printing mode for applying low gloss, and a high gloss printing mode that is a printing mode for applying high gloss, and the inkjet printing device satisfies the following formula:

$$T_{matte}>T_{gloss}$$

where $T_{matte}$ (degrees Celsius) is a temperature of the heating unit when printing is performed with the low gloss printing mode, and $T_{gloss}$ (degrees Celsius) is a temperature of the heating unit when printing is performed with the high gloss printing mode.

<2> The inkjet printing device according to <1>, wherein the inkjet printing device satisfies the following formula:

$$D_{gloss}>D_{matte}$$

where $D_{matte}$ is a printing rate of a print image of the low gloss printing mode and $D_{gloss}$ is a printing rate of a print image of the high gloss printing mode.

<3> The inkjet printing device according to <1> or <2>, wherein an amount of the resin in the clear ink is 8.0% by mass or greater.

<4> The inkjet printing device according to any one of <1> to <3>, wherein the clear ink includes a surfactant, and an amount of the surfactant in the clear ink is 2.0% by mass or less.

<5> The inkjet printing device according to any one of <1> to <4>, wherein the washing liquid includes water, a compound represented by General Formula (1), a glycol ether compound, and a surfactant, an amount of the glycol ether compound dissolved in 100 g of water of 25 degrees Celsius is greater than 5 g, and an amount of the glycol ether compound is 1% by mass or greater but 30% by mass or less,

[Chem.7]

General Formula (1)

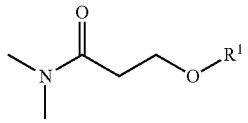

where, in General Formula (1), $R^1$ is an alkyl group having 1 or more but 4 or less carbon atoms.

<6> The inkjet printing device according to <5>, wherein, in General Formula (1), $R^1$ is a methyl group or a butyl group.

<7> The inkjet printing device according to <5> or <6>, wherein the glycol ether compound includes a dialkyl glycol ether compound represented by General Formula (2):

[Chem.8]

General Formula (2)

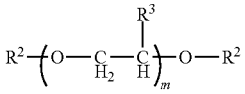

where, in General Formula (2), $R^2$ is $C_nH_{2n+1}$ where n is from 1 through 4, $R^3$ is a hydrogen atom or a methyl group, and m is an integer of from 1 through 4.

<8> The inkjet printing device according to any one of <5> to <7>, wherein the washing liquid further includes a glycol ether compound an amount of which dissolved in 100 g of water of 25 degrees Celsius is 5 g or less.

<9> The inkjet printing device according to any one of <5> to <8>, wherein the surfactant included in the washing liquid is a polyoxyalkylene surfactant.

<10> The inkjet printing device according to <9>, wherein the polyoxyalkylene surfactant is polyoxyethylene distyrenated phenyl ether, or polyoxyethylene polyoxypropylene alkyl ether, or both.

<11> The inkjet printing device according to any one of <5> to <10>, wherein an amount of the surfactant included in the washing liquid is 0.05% by mass or greater but 5% by mass or less.

<12> An inkjet printing method including:

ejecting an ink to a printing material using an ejection head having a nozzle to form a print layer;

heating the printing material printed; and washing a nozzle-formed surface of the ejection head with a washing liquid, wherein the ink is a clear ink including a resin, the inkjet printing method has a low gloss printing mode that is a printing mode for applying low gloss, and a high gloss printing mode that is a printing mode for applying high gloss, and the heating is heating to satisfy the following formula:

$$T_{matte} > T_{gloss}$$

where $T_{matte}$ (degrees Celsius) is a temperature of a heating unit in the heating when printing is performed with the low gloss printing mode, and $T_{gloss}$ (degrees Celsius) is a temperature of the heating unit in the heating when printing is performed with the high gloss printing mode.

<13> The inkjet printing method according to <12>, wherein the washing includes applying the washing liquid onto a wiping member, and wiping the nozzle-formed surface of the ejection head with the wiping member onto which the washing liquid is applied.

<14> The inkjet printing method according to <12> or <13>, wherein the washing liquid includes water, a compound represented by General Formula (1), a glycol ether compound, and a surfactant, an amount of the glycol ether compound dissolved in 100 g of water of 25 degrees Celsius is greater than 5 g, and an amount of the glycol ether compound is 1% by mass or greater but 30% by mass or less,

[Chem.9]

General Formula (1)

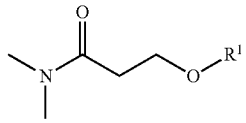

where, in General Formula, $R^1$ is an alkyl group having 1 or more but 4 or less carbon atoms.

<15> The inkjet printing method according to <14>, wherein, in General Formula (1), $R^1$ is a methyl group or a butyl group.

<16> The inkjet printing method according to <14> or <15>, wherein the glycol ether compound includes a dialkyl glycol ether compound represented by General Formula (2):

[Chem.10]

General Formula (2)

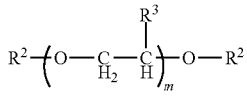

where, in General Formula (2), $R^2$ is $C_nH_{2n+1}$ where n is from 1 through 4, $R^3$ is a hydrogen atom or a methyl group, and m is an integer of from 1 through 4.

<17> The inkjet printing method according to any one of <12> to <16>, wherein the washing liquid further includes a glycol ether compound an amount of which dissolved in 100 g of water of 25 degrees Celsius is 5 g or less.

<18> The inkjet printing method according to any one of <14> to <17>, wherein the surfactant included in the washing liquid is a polyoxyalkylene surfactant.

<19> The inkjet printing method according to <18>, wherein the polyoxyalkylene surfactant is polyoxyethylene distyrenated phenyl ether, or polyoxyethylene polyoxypropylene alkyl ether, or both.

<20> The inkjet printing method according to any one of <14> to <19>, wherein an amount of the surfactant included in the washing liquid is 0.05% by mass or greater but 5% by mass or less.

<21> The inkjet printing method according to any one of <12> to <20>, wherein the wiping member is a non-woven cloth.

<22> A method for controlling glossiness of a print image, the method including:

ejecting an ink to a printing material using an ejection head having a nozzle to form a print layer;

heating the printed printing material with a heating unit; and washing a nozzle-formed surface of the ejection head with a washing liquid, wherein the ink is a clear ink including a resin, the method has a low gloss printing mode that is a printing mode for applying low gloss, and a high gloss printing mode that is a printing mode for applying high gloss, a temperature of a heating unit is controlled to be high when printing is performed with the low gloss printing mode, and a temperature of the heating unit is controlled to be low when printing is performed with high gloss printing mode.

<23> Printed matter including:

a printing material; and a print layer on the printing material, wherein the print layer is a clear ink layer including a resin, the printed matter includes a low gloss print image printed with a low gloss printing mode and a high gloss print image printed with a high gloss printing mode, a glossiness difference (Ga−Gb) between 60 degrees glossiness Ga of the high gloss print image and 60 degrees glossiness Gb of the printing material used with the high gloss printing mode is 20 or greater, and a glossiness difference (Gc−Gd) between 60 degrees glossiness Gc of the low gloss print image and 60 degrees glossiness Gd of the printing material used with the low gloss printing mode is 20 or less.

The inkjet printing device according to any one of <1> to <11>, the inkjet printing method according to any one of <12> to <21>, the method for controlling glossiness of a print image according to <22>, and the printed matter according to <23> can solve the above-described various problems existing in the art and can achieve the object of the present disclosure.

REFERENCE SIGNS LIST

400: image forming apparatus
401: exterior of image forming apparatus
401*c*: cover
404: cartridge holder
410, 410*k*, 410*c*, 410*m*, 410*y*: main tank
411: ink container
413: ink discharging outlet
414: container casing
420: mechanical unit
434: ejection head
436: supply tube
L: ink storage container

The invention claimed is:

1. An inkjet printing device including:

an ink storage unit configured to store an ink;

an ejection head having a nozzle configured to eject the ink to a printing material;

a heating unit configured to heat the printing material; and a washing unit configured to wash a nozzle-formed surface of the ejection head with a washing liquid, wherein the ink is a clear ink including a resin, wherein the amount of resin is 8.0% by or greater, the inkjet printing device has a low gloss printing mode that is a printing mode for applying low gloss, and a high gloss printing mode that is a printing mode for applying high gloss, the inkjet printing device satisfies the following formula:

$$T_{matte} > T_{gloss}$$

where $T_{matte}$ (degrees Celsius) is a temperature of the heating unit when printing is performed with the low gloss printing mode, and $T_{gloss}$ (degrees Celsius) is a temperature of the heating unit when printing is performed with the high gloss printing mode, the washing liquid includes water, a compound represented by General Formula (1), a glycol ether compound, and a surfactant, and an amount of the glycol ether compound dissolved in 100 g of water of 25 degrees Celsius is greater than 5 g, and an amount of the glycol ether compound is 1% by mass or greater but 30% by mass or less,

[Chem. 1]

General Formula (1)

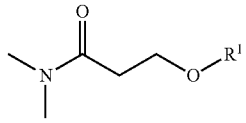

where, in General Formula (1), $R^1$ is an alkyl group having 1 or more but 4 or less carbon atoms.

2. The inkjet printing device according to claim 1, wherein the inkjet printing device satisfies the following formula:

$$D_{gloss} > D_{matte}$$

where $D_{matte}$ is a printing rate of a print image of the low gloss printing mode and $D_{gloss}$ is a printing rate of a print image of the high gloss printing mode.

3. The inkjet printing device according to claim 1, wherein the clear ink includes a surfactant, and an amount of the surfactant in the clear ink is 2.0% by mass or less.

4. The inkjet printing device according to claim 1, wherein, in General Formula (1), $R^1$ is a methyl group or a butyl group.

5. The inkjet printing device according to claim 1, wherein the glycol ether compound includes a dialkyl glycol ether compound represented by General Formula (2):

[Chem. 2]

General Formula (2)

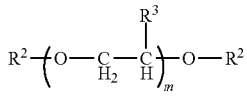

where, in General Formula (2), $R^2$ is $C_nH_{2n+1}$ where n is from 1 through 4, $R^3$ is a hydrogen atom or a methyl group, and m is an integer of from 1 through 4.

6. The inkjet printing device according to claim 1, wherein the washing liquid further includes a glycol ether compound an amount of which dissolved in 100 g of water of 25 degrees Celsius is 5 g or less.

7. The inkjet printing device according to claim 1, wherein the surfactant included in the washing liquid is a polyoxyalkylene surfactant.

8. The inkjet printing device according to claim 7, wherein the polyoxyalkylene surfactant is polyoxyethylene distyrenated phenyl ether, or polyoxyethylene polyoxypropylene alkyl ether, or both.

9. The inkjet printing device according to claim 1, wherein an amount of the surfactant included in the washing liquid is 0.05% by mass or greater but 5% by mass or less.

10. The inkjet printing device according to claim 1, wherein an amount of the resin in the clear ink is 8.0% by mass or greater but 25% by mass or less.

11. The inkjet printing device according to claim 1, wherein the resin in the clear ink comprises an acrylic resin.

12. The inkjet printing device according to claim 1, wherein the clear ink is a colorless transparent ink that is free of a colorant.

13. An inkjet printing method comprising:

ejecting an ink to a printing material using an ejection head having a nozzle to form a print layer;

heating the printing material printed; and washing a nozzle-formed surface of the ejection head with a washing liquid, wherein the ink is a clear ink including a resin, wherein the amount of resin is 8.0% by or greater, the inkjet printing method has a low gloss printing mode that is a printing mode for applying low gloss, and a high gloss printing mode that is a printing mode for applying high gloss, the heating is heating to satisfy the following formula:

$$T_{matte} > T_{gloss}$$

where $T_{matte}$ (degrees Celsius) is a temperature of a heating unit in the heating when printing is performed with the low gloss printing mode, and $T_{gloss}$ (degrees Celsius) is a temperature of the heating unit in the heating when printing is performed with the high gloss printing mode, the washing liquid includes water, a compound represented by General Formula (1), a glycol ether compound, and a surfactant, and an amount of the glycol ether compound dissolved in 100 g of water of 25 degrees Celsius is greater than 5 g, and an amount of the glycol ether compound is 1% by mass or greater but 30% by mass or less,

[Chem. 3]

General Formula (1)

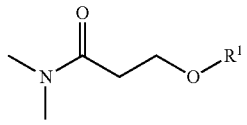

where, in General Formula, $R^1$ is an alkyl group having 1 or more but 4 or less carbon atoms.

14. The inkjet printing method according to claim 13, wherein the washing includes applying the washing liquid onto a wiping member, and wiping the nozzle-formed surface of the ejection head with the wiping member onto which the washing liquid is applied.

15. The inkjet printing method according to claim 13, wherein, in General Formula (1), $R^1$ is a methyl group or a butyl group.

16. The inkjet printing method according to claim 13, wherein the glycol ether compound includes a dialkyl glycol ether compound represented by General Formula (2):

[Chem. 4]

General Formula (2)

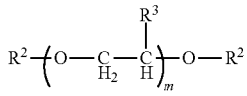

where, in General Formula (2), $R^2$ is $C_nH_{2n+1}$ where n is from 1 through 4, $R^3$ is a hydrogen atom or a methyl group, and m is an integer of from 1 through 4.

17. The inkjet printing method according to claim 13, wherein the washing liquid further includes a second glycol ether compound an amount of which dissolved in 100 g of water of 25 degrees Celsius is 5 g or less.

18. The inkjet printing method according to claim 13, wherein the surfactant included in the washing liquid is a polyoxyalkylene surfactant.

19. The inkjet printing method according to claim 18, wherein the polyoxyalkylene surfactant is polyoxyethylene distyrenated phenyl ether, or polyoxyethylene polyoxypropylene alkyl ether, or both.

20. The inkjet printing method according to claim 13, wherein an amount of the surfactant included in the washing liquid is 0.05% by mass or greater but 5% by mass or less.

* * * * *